US007842163B2

(12) United States Patent
Nickel et al.

(10) Patent No.: US 7,842,163 B2
(45) **Date of Patent: *Nov. 30, 2010**

(54) EMBOSSED TISSUE PRODUCTS

(75) Inventors: Deborah Nickel, Appleton, WI (US); Michael R. Lostocco, Appleton, WI (US); Thomas Joseph Dyer, Neenah, WI (US); Troy M. Runge, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 665 days.

This patent is subject to a terminal disclaimer.

(21) Appl. No.: 11/304,998

(22) Filed: Dec. 15, 2005

(65) Prior Publication Data

US 2007/0137813 A1 Jun. 21, 2007

(51) Int. Cl.
*D21H 19/20* (2006.01)
*D21H 21/18* (2006.01)
*D21H 17/34* (2006.01)

(52) U.S. Cl. ..... 162/168.1; 162/109; 162/124; 162/158; 162/179; 162/204; 162/184

(58) Field of Classification Search ..... 162/109, 162/124, 158, 168.1, 179, 204
See application file for complete search history.

(56) References Cited

U.S. PATENT DOCUMENTS 3,338,992 A 8/1967 Kinney
3,341,394 A 9/1967 Kinney
3,502,538 A 3/1970 Petersen
3,502,763 A 3/1970 Hartmann
3,542,615 A 11/1970 Dobo et al.
3,556,932 A 1/1971 Coscia et al.

(Continued)

FOREIGN PATENT DOCUMENTS

CA 2273912 7/1998

(Continued)

OTHER PUBLICATIONS

Search Report and Written Opinion for PCT/US2006/033224, Dec. 27, 2006.

(Continued)

*Primary Examiner*—Eric Hug
*Assistant Examiner*—Dennis Cordray
(74) *Attorney, Agent, or Firm*—Dority & Manning, P.A.

(57) ABSTRACT

Tissue products are disclosed containing an additive composition. The additive composition, for instance, comprises an aqueous dispersion containing an olefin polymer, an ethylene-carboxylic acid copolymer, or mixtures thereof. The olefin polymer may comprise an interpolymer of ethylene and octene, while the ethylene-carboxylic acid copolymer may comprise ethylene-acrylic acid copolymer. The additive composition may also contain a dispersing agent, such as a fatty acid. The additive composition may be incorporated into the tissue web by being combined with the fibers that are used to form the web. Alternatively, the additive composition may be topically applied to the web after the web has been formed. After the additive composition is applied to the web or otherwise incorporated into the tissue web, the tissue web is embossed. During embossing, the additive composition forms well defined embossments in the web that are water resistant. In one embodiment, the additive composition may also be used to bond multiple tissue webs together to form a multiple ply product during the embossing operation.

42 Claims, 11 Drawing Sheets

U.S. PATENT DOCUMENTS 3,556,933 A 1/1971 Williams et al.
3,575,173 A 4/1971 Loyer
3,585,104 A 6/1971 Kleinert
3,645,992 A 2/1972 Elston
3,669,822 A 6/1972 Cowen
3,692,618 A 9/1972 Dorschner et al.
3,700,623 A 10/1972 Keim
3,772,076 A 11/1973 Keim
3,802,817 A 4/1974 Matsuki et al.
3,849,241 A 11/1974 Butin et al.
3,855,158 A 12/1974 Petrovich et al.
3,879,257 A 4/1975 Gentile et al.
3,899,388 A 8/1975 Petrovich et al.
4,076,698 A 2/1978 Anderson et al.
4,100,324 A 7/1978 Anderson et al.
4,129,528 A 12/1978 Petrovich et al.
4,147,586 A 4/1979 Petrovich et al.
4,222,921 A 9/1980 Van Eenam
4,309,510 A 1/1982 Kleber
4,326,000 A 4/1982 Roberts, Jr.
4,340,563 A 7/1982 Appel et al.
4,355,066 A 10/1982 Newman
4,375,448 A 3/1983 Appel et al.
4,440,898 A 4/1984 Pomplun et al.
4,494,278 A 1/1985 Kroyer et al.
4,514,345 A 4/1985 Johnson et al.
4,528,239 A 7/1985 Trokhan
4,574,021 A 3/1986 Endres et al.
4,594,130 A 6/1986 Chang et al.
4,599,392 A 7/1986 McKinney et al.
4,640,810 A 2/1987 Laursen et al.
4,793,898 A 12/1988 Laamanen et al.
4,818,464 A 4/1989 Lau
4,837,070 A 6/1989 Weber et al.
4,950,545 A 8/1990 Walter et al.
4,975,320 A 12/1990 Goldstein et al.
4,988,781 A 1/1991 McKinney et al.
5,008,344 A 4/1991 Bjorkquist
5,085,736 A 2/1992 Bjorkquist
5,098,522 A 3/1992 Smurkoski et al.
5,104,923 A 4/1992 Steinwand et al.
5,109,063 A 4/1992 Cheng et al.
5,129,988 A 7/1992 Farrington, Jr.
5,160,484 A 11/1992 Nikoloff
5,227,242 A 7/1993 Walter et al.
5,260,171 A 11/1993 Smurkoski et al.
5,272,236 A 12/1993 Lai et al.
5,275,700 A 1/1994 Trokhan
5,278,272 A 1/1994 Lai et al.
5,328,565 A 7/1994 Rasch et al.
5,334,289 A 8/1994 Trokhan et al.
5,382,400 A 1/1995 Pike et al.
5,384,373 A 1/1995 McKinney et al.
5,385,643 A 1/1995 Ampulski
5,389,202 A 2/1995 Everhart et al.
5,389,204 A 2/1995 Ampulski
5,429,686 A 7/1995 Chiu et al.
5,431,786 A 7/1995 Rasch et al.
5,432,000 A 7/1995 Young et al.
5,496,624 A 3/1996 Stelljes, Jr. et al.
5,500,277 A 3/1996 Trokhan et al.
5,514,523 A 5/1996 Trokhan et al.
5,518,585 A 5/1996 Huth et al.
5,527,171 A 6/1996 Soerensen
5,529,665 A 6/1996 Kaun
5,543,215 A 8/1996 Hansen et al.
5,554,467 A 9/1996 Trokhan et al.
5,558,873 A 9/1996 Funk et al.
5,566,724 A 10/1996 Trokhan et al.
5,573,637 A 11/1996 Ampulski et al.
5,595,628 A 1/1997 Gordon et al.
5,624,790 A 4/1997 Trokhan et al.
5,628,876 A 5/1997 Ayers et al.
5,656,132 A 8/1997 Farrington, Jr. et al.
5,672,248 A 9/1997 Wendt et al.
5,677,383 A 10/1997 Chum et al.
5,702,571 A * 12/1997 Kamps et al. ..... 162/117
5,830,320 A 11/1998 Park et al.
5,844,045 A 12/1998 Kolthammer et al.
5,869,575 A 2/1999 Kolthammer et al.
5,871,763 A 2/1999 Luu et al.
5,885,697 A 3/1999 Krzysik et al.
5,935,384 A 8/1999 Taniguchi
6,033,761 A 3/2000 Dwiggins et al.
6,054,020 A 4/2000 Goulet et al.
6,096,152 A 8/2000 Anderson et al.
6,096,169 A 8/2000 Hermans et al.
6,111,023 A 8/2000 Chum et al.
6,120,642 A 9/2000 Lindsay et al.
6,129,815 A 10/2000 Larson et al.
6,143,135 A 11/2000 Hada et al.
6,171,441 B1 1/2001 Phillips et al.
6,194,517 B1 2/2001 Pomplun et al.
6,197,154 B1 3/2001 Chen et al.
6,224,714 B1 5/2001 Schroeder et al.
6,231,719 B1 5/2001 Garvey et al.
6,274,667 B1 8/2001 Shannon et al.
6,287,418 B1 9/2001 Schroeder et al.
6,291,372 B1 9/2001 Mumick et al.
6,316,549 B1 11/2001 Chum et al.
6,361,784 B1 3/2002 Brennan et al.
6,365,667 B1 4/2002 Shannon et al.
6,379,498 B1 4/2002 Burns et al.
6,423,270 B1 7/2002 Wall
6,447,643 B2 9/2002 Fingal et al.
6,448,341 B1 9/2002 Kolthammer et al.
6,468,392 B2 * 10/2002 Oriarian et al. ..... 162/109
6,538,070 B1 3/2003 Cardwell et al.
6,566,446 B1 5/2003 Parikh et al.
6,570,054 B1 5/2003 Gatto et al.
6,617,490 B1 9/2003 Chen et al.
6,716,203 B2 4/2004 Sorebo et al.
6,764,988 B2 7/2004 Koenig et al.
6,908,966 B2 6/2005 Chang et al.
6,911,573 B2 6/2005 Chen et al.
6,913,673 B2 7/2005 Baggot et al.
6,951,598 B2 10/2005 Flugge et al.
6,991,706 B2 1/2006 Lindsay et al.
6,994,865 B2 2/2006 Branham et al.
2002/0103469 A1 8/2002 Chen et al.
2002/0115744 A1 8/2002 Svenningsen et al.
2002/0162243 A1 11/2002 Runge et al.
2003/0027470 A1 2/2003 Chang et al.
2003/0072950 A1 4/2003 Rodrigues et al.
2003/0121627 A1 7/2003 Hu et al.
2004/0020114 A1 2/2004 Boehmer et al.
2004/0084165 A1 5/2004 Shannon et al.
2004/0099388 A1 5/2004 Chen et al.
2004/0099389 A1 5/2004 Chen et al.
2004/0118532 A1 6/2004 Sarbo et al.
2004/0118540 A1 6/2004 Garnier et al.
2004/0191486 A1 9/2004 Underhill et al.
2004/0209539 A1 10/2004 Confalone et al.
2004/0234804 A1 11/2004 Liu et al.
2005/0010075 A1 1/2005 Powers
2005/0045292 A1 3/2005 Lindsay
2005/0045294 A1 3/2005 Goulet et al.
2005/0045295 A1 3/2005 Goulet et al.
2005/0058693 A1 3/2005 Joseph et al.
2005/0058833 A1 3/2005 Krzysik et al.
2005/0100754 A1 5/2005 Moncla et al.
2005/0118435 A1 6/2005 DeLucia et al.
2005/0124753 A1 6/2005 Ashihara et al.
2005/0136766 A1 6/2005 Tanner et al.

| | | | |
|---|---|---|---|
| 2005/0148257 | A1 | 7/2005 | Hermans et al. |
| 2005/0192365 | A1 | 9/2005 | Strandburg et al. |
| 2005/0214335 | A1 | 9/2005 | Allen et al. |
| 2005/0217874 | A1 | 10/2005 | Forster et al. |
| 2005/0224200 | A1 | 10/2005 | Bouchard et al. |
| 2005/0241789 | A1 | 11/2005 | Reddy |
| 2006/0014884 | A1 | 1/2006 | Goulet et al. |
| 2006/0070712 | A1 | 4/2006 | Runge et al. |
| 2006/0085998 | A1 | 4/2006 | Herman et al. |
| 2006/0086472 | A1 | 4/2006 | Hermans et al. |
| 2007/0020315 | A1 | 1/2007 | Shannon et al. |
| 2007/0137808 | A1 | 6/2007 | Lostocco et al. |
| 2007/0137809 | A1 | 6/2007 | Dyer et al. |
| 2007/0137810 | A1 | 6/2007 | Dyer et al. |
| 2007/0137811 | A1 | 6/2007 | Runge et al. |
| 2007/0137813 | A1 | 6/2007 | Nickel et al. |
| 2007/0141936 | A1 | 6/2007 | Bunyard et al. |
| 2007/0144697 | A1 | 6/2007 | Dyer et al. |
| 2007/0295464 | A1 | 12/2007 | Fetner et al. |
| 2008/0000598 | A1 | 1/2008 | Dyer et al. |
| 2008/0000602 | A1 | 1/2008 | Dyer et al. |
| 2008/0041543 | A1 | 2/2008 | Dyer et al. |
| 2008/0073045 | A1 | 3/2008 | Dyer et al. |
| 2008/0073046 | A1 | 3/2008 | Dyer et al. |
| 2008/0135195 | A1 | 6/2008 | Hermans et al. |

FOREIGN PATENT DOCUMENTS

| | | | |
|---|---|---|---|
| DE | 41 42 460 | A1 | 6/1993 |
| EP | 0608460 | A1 | 1/1993 |
| EP | 0620256 | A2 | 3/1994 |
| EP | 0857453 | A1 | 2/1997 |
| EP | 0926288 | B1 | 6/1999 |
| EP | 1344511 | A2 | 9/2003 |
| GB | 142441 | | 7/1974 |
| GB | 2246373 | A | 1/1992 |
| WO | WO 9501479 | | 1/1995 |
| WO | WO 97/33921 | | 9/1997 |
| WO | WO 9934057 | A1 | 7/1999 |
| WO | WO 0066835 | A1 | 11/2000 |
| WO | WO 0147699 | | 7/2001 |
| WO | WO 0149933 | | 7/2001 |
| WO | WO 0248458 | A1 | 6/2002 |
| WO | WO 03040442 | A1 | 5/2003 |
| WO | WO 2005021622 | A2 | 3/2005 |
| WO | WO 2005021622 | A3 | 3/2005 |
| WO | WO 2005021638 | A2 | 3/2005 |
| WO | WO 2005021638 | A3 | 3/2005 |
| WO | WO 2005031068 | A1 | 4/2005 |
| WO | WO 2005080677 | A2 | 9/2005 |
| WO | WO 2006/038977 | | 4/2006 |
| WO | WO 2007/070114 | | 6/2007 |
| WO | WO 2007070129 | A1 | 6/2007 |
| WO | WO 2007070145 | A1 | 6/2007 |
| WO | WO 2007070153 | A1 | 6/2007 |
| WO | WO 2007075356 | A1 | 7/2007 |
| WO | WO 2007078342 | A1 | 7/2007 |
| WO | WO 2007078499 | A1 | 7/2007 |

OTHER PUBLICATIONS

ASTM Designation: D 1238-04c entitled Standard Test Method for Melt Flow Rates of Thermoplastics by Extrusion Plastometer, Dec. 1, 2004, pp. 1-14.

ASTM Designation: D 792-98 entitled Standard Test Method for Density and Specific Gravity (Relative Density) of Plastics by Displacement, Aug. 10, 1998, pp. 159-163.

Material Safety Data Sheet from DuPont Dow Elastomers L. L. C., for "ENGAGE", Mar. 29, 1999, 7 pages.

Paper entitled "Polymer Nanocomposite" by Chou et al. of The Dow Chemical Company, 2002, 5 pages.

Product Information for Affinity EG 8200 (Polyolefin Plastomer for General Plastomeric Applications) from the Dow Chemical Company, May 2001, 2 pages.

TAPPI-T 411 om-89 entitled "Thickness (caliper) of paper, paperboard, and combined board", Jun. 15, 1989, 3 pages.

U.S. Appl. No. 10/956,695, filed Oct. 1, 2004, Flugge-Berendes et al., Absorbent Articles Comprising Thermoplastic Resin Pretreated Fibers.

U.S. Appl. No. 10/975,796, filed Oct. 27, 2004, Lindsay et al., Soft Durable Paper Product.

U.S. Appl. No. 11/300,967, filed Dec. 15, 2005, Branham et al., Dispersible Wet Wipes with Improved Dispensing.

U.S. Appl. No. 11/303,002, filed Dec. 15, 2005, Lostocco et al., Treated Tissue Products Having Increased Strength.

U.S. Appl. No. 11/303,036, filed Dec. 15, 2005, Dyer et al., Tissue Products Containing a Polymer Dispersion.

U.S. Appl. No. 11/304,063, filed Dec. 15, 2005, Dyer et al., Creping Process and Products Made Therefrom.

U.S. Appl. No. 11/304,490, filed Dec. 15, 2005, Runge et al., Premoistened Tissue Products.

Search Report for Int'l Appl. No. PCT/US2006/037844 mailed Feb. 1, 2007.

Search Report and Written Opinion for PCT/US2006/047785, Oct. 5, 2007.

Search Report and Written Opinion for PCT/IB2007/054405, completed Feb. 28, 2008.

Search Report and Written Opinion for PCT/US2006/033227, Jun. 5, 2007.

U.S. Appl. No. 11/635,379, filed Dec. 7, 2006, Hermans et al., Process for Producing Tissue Products.

U.S. Appl. No. 11/635,385, filed Dec. 7, 2006, Dyer et al., Additive Compositions for Treating Various Base Sheets.

U.S. Appl. No. 11/818,504, filed Jun. 14, 2007, Dyer et al., Process for Increasing the Basis Weight of Sheet Materials.

U.S. Appl. No. 11/818,505, filed Jun. 14, 2007, Dyer et al., Additive Compositions for Treating Various Base Sheets.

U.S. Appl. No. 11/818,512, filed Jun. 14, 2007, Dyer et al., Tissue Products Having Controlled Lint Properties.

U.S. Appl. No. 11/818,513, filed Jun. 14, 2007, Dyer et al., Process for Increasing the Basis Weight of Sheet Materials.

U.S. Appl. No. 11/818,529, filed Jun. 14, 2007, Dyer et al., Wiping Products HAving Enhanced Cleaning Abilities.

U.S. Appl. No. 11/635,379, filed Dec. 7, 2006 entitled "Process for Producing Tissue Products".

U.S. Appl. No. 11/635,379, filed Dec. 7, 2006 entitled "Process for Producing Tissue Products".

Search Report and Written Opinion for PCT/US2006/038991 dated Feb. 9, 2007.

Search Report and Written Opinion for PCT/IB2007/046062 dated May 3, 2007.

Search Report and Written Opinion for PCT/IB2007/054404 dated May 21, 2008.

Search Report and Written Opinion for PCT/IB2007/054651 dated Aug. 4, 2008.

Search Report and Written Opinion for PCT/IB2007/054652 dated Aug. 4, 2008.

Search Report and Written Opinion for PCT/IB2007/054367 dated Aug. 4, 2008.

* cited by examiner

EMBOSSED TISSUE PRODUCTS

BACKGROUND OF THE INVENTION

Consumer tissue products such as facial tissue, bath tissue and paper wipers are generally used to absorb liquids and fluids. Such paper products are predominantly formed of cellulosic papermaking fibers by manufacturing techniques designed specifically to produce several important properties. For example, the products should have good bulk, a soft feel, and should be highly absorbent. Further, the products should also have a pleasant aesthetic appearance and should be resilient against delamination in the environment in which they are used.

In the past, many attempts have been made to enhance certain physical properties of such products. For instance, to enhance the aesthetic appearance, a decorative paper product has been created by embossing a pattern onto one or both sides of the paper web during manufacturing. This standard mechanical embossing resulted in the deformation or breaking of fibers in an attempt to physically press the pattern into the web. In some applications, the resulting embossed patterns were not well-defined and faded as the paper product aged. Also, embossing patterns into tissue webs typically reduces the strength of the web.

Further, a variety of approaches have been employed over the years in an attempt to improve the bonding properties between multiple plies of paper products. One approach includes applying an adhesive between the plies before passing the paper web through a nip under pressure. Another approach includes using paper plies having different creping characteristics to form a bonded paper product with fiber entanglement. Although these processes provide suitable multi-ply paper products, the processes that apply conventional adhesives in between the webs typically require relatively high process costs since the lamination process has relatively low rates of operation.

In view of the above, a need currently exists for an improved embossed tissue product. Also, a need exists for an improved process for laminating two or more tissue webs together.

SUMMARY OF THE INVENTION

In general, the present disclosure is directed to embossed tissue products. More particularly, an additive composition is applied to a tissue web that forms densified areas such as defined embossments when the tissue web is later embossed. When present in between two tissue webs, the additive composition can also form bond areas for bonding the two webs together when subjected to sufficient heat and pressure. The tissue product may comprise, for instance, a bath tissue, a facial tissue, a paper towel, an industrial wiper, and the like. The tissue product may contain one ply or may contain multiple plies. The additive composition can be incorporated into the tissue product in order to provide various advantages without significantly affecting the softness and/or blocking behavior of the product in a negative manner. In fact, the additive composition has been found to preserve the strength or improve the strength of the tissue web even after undergoing an embossing process.

The additive composition may comprise, for instance, an aqueous dispersion containing a thermoplastic resin. The additive composition may be added to the tissue product via fiber pre-treatments prior to slurry generation, wet-end addition, and/or topically applied to the web during or after the formation process. In one embodiment, the additive composition is applied topically to the tissue web during a creping operation.

In one embodiment, for instance, the present disclosure is directed to a tissue product comprising a tissue web containing pulp fibers. The tissue web, for instance, may have a dry bulk of at least 3 cc/g. In accordance with the present disclosure, the tissue product further comprises an additive composition present on or in the tissue web. The additive composition may comprise non-fibrous olefin polymers, such as alpha-olefin polymers and/or an ethylene-carboxylic acid copolymer. Once the tissue web is embossed, the additive composition forms defined embossments in the tissue web. For instance, during embossing, the tissue web may be subjected to heat and/or pressure in an amount sufficient to soften the one or more polymers and form defined embossed areas. The embossments can be visible from one or both sides of the tissue web.

The additive composition, for instance, may comprise a film-forming composition and the olefin polymer may comprise an interpolymer of ethylene and at least one comonomer comprising an alkene, such as 1-octene. The additive composition may also contain a dispersing agent, such as a carboxylic acid. Examples of particular dispersing agents, for instance, include fatty acids, such as oleic acid or stearic acid.

In one particular embodiment, the additive composition may contain an ethylene and octene copolymer in combination with an ethylene-acrylic acid copolymer. The ethylene-acrylic acid copolymer is not only a thermoplastic resin, but may also serve as a dispersing agent. The ethylene and octene copolymer may be present in combination with the ethylene-acrylic acid copolymer in a weight ratio of from about 1:10 to about 10:1, such as from about 2:3 to about 3:2.

The polymer composition may exhibit a crystallinity of less than about 50%, such as less than about 20%. The olefin polymer may also have a melt index of less than about 1000 g/10 min, such as less than about 700 g/10 min. The olefin polymer may also have a relatively small particle size, such as from about 0.1 micron to about 5 microns when contained in an aqueous dispersion.

The additive composition may be combined with pulp fibers prior to forming the tissue web. Alternatively or in addition, the additive composition may be topically applied to at least one side of the tissue web. For instance, the additive composition may be sprayed or printed onto the tissue web. In one particular embodiment, the tissue web is creped after application of the additive composition.

The basis weight of the tissue web may vary depending upon the particular product being formed. For bath tissues and facial tissues, for instance, the tissue web may have a basis weight of from about 6 gsm to about 40 gsm. For paper towels or wiping implements, on the other hand, the tissue web may have a basis weight of from about 15 gsm to about 90 gsm. The tissue web bulk may also vary from about 3 cc/g to 20 cc/g, such as from about 5 cc/g to 15 cc/g.

The additive composition may be applied to the tissue web in an amount from about 0.1% to about 50% by weight, such as from about 0.5% to about 10% by weight.

Once applied to or incorporated into a tissue web, in accordance with the present disclosure, the tissue web may be embossed by being fed through a nip formed between two embossing rolls or between an embossing roll and a smooth roll. The embossing elements contact the web at a pressure and/or temperature sufficient to soften the thermoplastic polymer and cause the polymer to flow forming defined embossments. Of particular advantage, not only are the embossments well defined and visible but also the additive composition prevents the web from deteriorating in strength during the embossing process.

When two or more plies are embossed together, the additive composition not only forms defined embossed areas, but also forms bond areas between the two or more webs.

The one or more tissue webs may be embossed according to any suitable pattern. For instance, an embossing pattern may be used that comprises a reticulated pattern or, alternatively, the embossing pattern may comprise a pattern of discrete shapes. In one embodiment, two or more tissue webs are embossed together only along the edges of the webs in order to attach the webs together in what is referred to as a crimping process.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
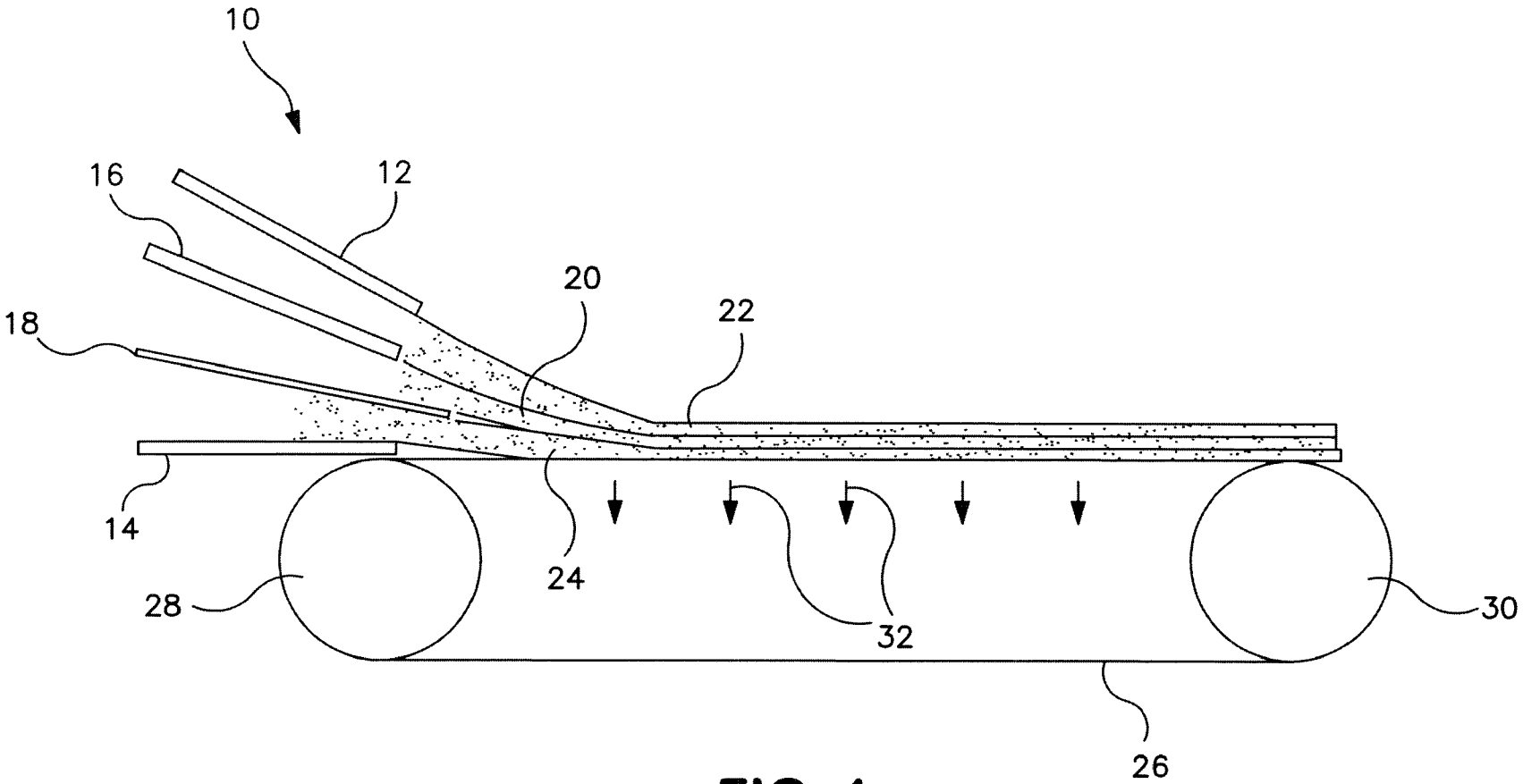
FIG. 1 is a schematic diagram of a tissue web forming machine, illustrating the formation of a stratified tissue web having multiple layers in accordance with the present disclosure.

Repeat use of reference characters in the present specification and drawings is intended to represent same or analogous features or elements of the present disclosure.

DETAILED DESCRIPTION

It is to be understood by one of ordinary skill in the art that the present discussion is a description of exemplary embodiments only, and is not intended as limiting the broader aspects of the present disclosure.

In general, the present disclosure is directed to the incorporation of an additive composition containing a thermoplastic polymer into a tissue web in order to emboss the web. During an embossing process, the additive composition can be subjected to heat and/or pressure in an amount sufficient to cause the thermoplastic polymer to flow and form densified areas, such as defined embossments. The tissue web can be embossed for various different reasons. For example, in one embodiment, the tissue web may be embossed simply to improve the aesthetic appearance of the web. Alternatively, the web may be embossed in order to improve the wet strength and/or the dry strength of the web. Embossing the web may also improve various other properties.

In one embodiment, embossing the web containing the additive composition may be done in order to adhere the web to one or more other webs during the formation of a multi-ply product. In particular, the additive composition during the embossing process can form bond areas between adjacent webs.

Of particular advantage, the additive composition forms the above described embossments and/or bond areas without significantly decreasing the softness or decreasing the strength of the web. Further, the additive composition does not create the same type of blocking problems that have been experienced in the past when using conventional adhesives and binders.

The additive composition may comprise a polyolefin dispersion. For example, the polyolefin dispersion may contain polymeric particles having a relatively small size, such as less than about 5 microns, in an aqueous medium when applied or incorporated into a tissue web. Once dried, however, the polymeric particles are generally indistinguishable. For example, in one embodiment, the additive composition may comprise a film-forming composition that forms a discontinuous but interconnected film. In some embodiments, the polyolefin dispersion may also contain a dispersing agent.

As will be described in greater detail below, the additive composition can be incorporated into a tissue web using various techniques and during different stages of production of the tissue product. For example, in one embodiment, the additive composition can be combined with an aqueous suspension of fibers that is used to form the tissue web. In an alternative embodiment, the additive composition can be applied to a dry pulp sheet that is used to form an aqueous suspension of fibers. In still another embodiment, the additive composition may be topically applied to the tissue web while the tissue web is wet or after the tissue web has been dried. For instance, in one embodiment, the additive composition may be applied topically to the tissue web during a creping operation. In particular, the additive composition has been found well-suited for adhering a tissue web to a creping surface during a creping process.

The additive composition generally contains an aqueous dispersion comprising at least one thermoplastic resin, water, and, optionally, at least one dispersing agent. The thermoplastic resin is present within the dispersion at a relatively small particle size. For example, the average polymeric particle size of the polymer may be less than about 5 microns. The actual particle size may depend upon various factors including the thermoplastic polymer that is present in the dispersion. Thus, the average volumetric particle size may be from about 0.05 microns to about 5 microns, such as less than about 4 microns, such as less than about 3 microns, such as less than about 2 microns, such as less than about 1 micron. Particle sizes can be measured on a Coulter LS230 light-scattering particle size analyzer or other suitable device. When present in the aqueous dispersion and when present in the tissue web, the thermoplastic resin is typically found in a non-fibrous form.

The particle size distribution of the polymer particles in the dispersion may be less than or equal to about 2.0, such as less than 1.9, 1.7 or 1.5.

Examples of aqueous dispersions that may be incorporated into the additive composition of the present disclosure are disclosed, for instance, in U.S. Patent Application Publication No. 2005/0100754, U.S. Patent Application Publication No. 2005/0192365, PCT Publication No. WO 2005/021638, and PCT Publication No. WO 2005/021622, which are all incorporated herein by reference.

The thermoplastic resin contained within the additive composition may vary depending upon the particular application and the desired result. In one embodiment, for instance, thermoplastic resin is an olefin polymer. As used herein, an olefin polymer refers to a class of unsaturated open-chain hydrocarbons having the general formula $C_nH_{2n}$. The olefin polymer may be present as a copolymer, such as an interpolymer. As used herein, a substantially olefin polymer refers to a polymer that contains less than about 1% substitution.

In one particular embodiment, for instance, the olefin polymer may comprise an alpha-olefin interpolymer of ethylene with at least one comonomer selected from the group consisting of a $C_4$-$C_{20}$ linear, branched or cyclic diene, or an ethylene vinyl compound, such as vinyl acetate, and a compound represented by the formula $H_2C{=}CHR$ wherein R is a $C_1$-$C_{20}$ linear, branched or cyclic alkyl group or a $C_6$-$C_{20}$ aryl group. Examples of comonomers include propylene, 1-butene, 3-methyl-1-butene, 4-methyl-1-pentene, 3-methyl-1-pentene, 1-heptene, 1-hexene, 1-octene, 1-decene, and 1-dodecene. In some embodiments, the interpolymer of ethylene has a density of less than about 0.92 g/cc.

In other embodiments, the thermoplastic resin comprises an alpha-olefin interpolymer of propylene with at least one comonomer selected from the group consisting of ethylene, a $C_4$-$C_{20}$ linear, branched or cyclic diene, and a compound represented by the formula $H_2C{=}CHR$ wherein R is a $C_1$-$C_{20}$ linear, branched or cyclic alkyl group or a $C_6$-$C_{20}$ aryl group. Examples of comonomers include ethylene, 1-butene, 3-methyl-1-butene, 4-methyl-1-pentene, 3-methyl-1-pentene, 1-heptene, 1-hexene, 1-octene, 1-decene, and 1-dodecene. In some embodiments, the comonomer is present at about 5% by weight to about 25% by weight of the interpolymer. In one embodiment, a propylene-ethylene interpolymer is used.

Other examples of thermoplastic resins which may be used in the present disclosure include homopolymers and copolymers (including elastomers) of an olefin such as ethylene, propylene, 1-butene, 3-methyl-1-butene, 4-methyl-1-pentene, 3-methyl-1-pentene, 1-heptene, 1-hexene, 1-octene, 1-decene, and 1-dodecene as typically represented by polyethylene, polypropylene, poly-1-butene, poly-3-methyl-1-butene, poly-3-methyl-1-pentene, poly-4-methyl-1-pentene, ethylene-propylene copolymer, ethylene-1-butene copolymer, and propylene-1-butene copolymer; copolymers (including elastomers) of an alpha-olefin with a conjugated or non-conjugated diene as typically represented by ethylene-butadiene copolymer and ethylene-ethylidene norbornene copolymer; and polyolefins (including elastomers) such as copolymers of two or more alpha-olefins with a conjugated or non-conjugated diene as typically represented by ethylene-propylene-butadiene copolymer, ethylene-propylene-dicyclopentadiene copolymer, ethylene-propylene-1,5-hexadiene copolymer, and ethylene-propylene-ethylidene norbornene copolymer; ethylene-vinyl compound copolymers such as ethylene-vinyl acetate copolymers with N-methylol functional comonomers, ethylene-vinyl alcohol copolymers with N-methylol functional comonomers, ethylene-vinyl chloride copolymer, ethylene acrylic acid or ethylene-(meth)acrylic acid copolymers, and ethylene-(meth)acrylate copolymer; styrenic copolymers (including elastomers) such as polystyrene, ABS, acrylonitrile-styrene copolymer, methylstyrene-styrene copolymer; and styrene block copolymers (including elastomers) such as styrene-butadiene copolymer and hydrate thereof, and styrene-isoprene-styrene triblock copolymer; polyvinyl compounds such as polyvinyl chloride, polyvinylidene chloride, vinyl chloride-vinylidene chloride copolymer, polymethyl acrylate, and polymethyl methacrylate; polyamides such as nylon 6, nylon 6,6, and nylon 12; thermoplastic polyesters such as polyethylene terephthalate and polybutylene terephthalate; polycarbonate, polyphenylene oxide, and the like. These resins may be used either alone or in combinations of two or more.

In particular embodiments, polyolefins such as polypropylene, polyethylene, and copolymers thereof and blends thereof, as well as ethylene-propylene-diene terpolymers are used. In some embodiments, the olefinic polymers include homogeneous polymers described in U.S. Pat. No. 3,645,992 by Elston; high density polyethylene (HDPE) as described in U.S. Pat. No. 4,076,698 to Anderson; heterogeneously branched linear low density polyethylene (LLDPE); heterogeneously branched ultra low linear density (ULDPE); homogeneously branched, linear ethylene/alpha-olefin copolymers; homogeneously branched, substantially linear ethylene/alpha-olefin polymers which can be prepared, for example, by a process disclosed in U.S. Pat. Nos. 5,272,236 and 5,278,272, the disclosure of which process is incorporated herein by reference; and high pressure, free radical polymerized ethylene polymers and copolymers such as low density polyethylene (LDPE).

In still another embodiment of the present invention, the thermoplastic resin comprises an ethylene-carboxylic acid copolymer, such as, ethylene-acrylic acid (EAA) and ethylene-methacrylic acid copolymers such as for example those available under the tradenames PRIMACOR™ from the Dow Chemical Company, Nucrel™ from DuPont, and Escor™ from ExxonMobil, and described in U.S. Pat. Nos. 4,599,392, 4,988,781, and 5,384,373, each of which is incorporated herein by reference in its entirety, and ethylene-vinyl acetate (EVA) copolymers. Polymer compositions described in U.S. Pat. Nos. 6,538,070, 6,566,446, 5,869,575, 6,448,341, 5,677,383, 6,316,549, 6,111,023, or 5,844,045, each of which is incorporated herein by reference in its entirety, are also suitable in some embodiments. Of course, blends of polymers can be used as well. In some embodiments, the blends include two different Ziegler-Natta polymers. In other embodiments, the blends can include blends of a Ziegler-Natta and a metallocene polymer. In still other embodiments, the thermoplastic resin used herein is a blend of two different metallocene polymers.

In one particular embodiment, the thermoplastic resin comprises an alpha-olefin interpolymer of ethylene with a comonomer comprising an alkene, such as 1-octene. The ethylene and octene copolymer may be present alone in the additive composition or in combination with another thermoplastic resin, such as ethylene-acrylic acid copolymer. Of particular advantage, the ethylene-acrylic acid copolymer not only is a thermoplastic resin, but also serves as a dispersing agent. For some embodiments, the additive composition should comprise a film-forming composition. It has been found that the ethylene-acrylic acid copolymer may assist in forming films, while the ethylene and octene copolymer lowers the stiffness. When applied to a tissue web, the composition may or may not form a film within the product, depending upon how the composition is applied and the amount of the composition that is applied. When forming a film on the tissue web, the film may be continuous or discontinuous. When present together, the weight ratio between the ethylene and octene copolymer and the ethylene-acrylic acid copolymer may be from about 1:10 to about 10:1, such as from about 3:2 to about 2:3.

The thermoplastic resin, such as the ethylene and octene copolymer, may have a crystallinity of less than about 50%, such as less than about 25%. The polymer may have been produced using a single site catalyst and may have a weight average molecular weight of from about 15,000 to about 5 million, such as from about 20,000 to about 1 million. The molecular weight distribution of the polymer may be from about 1.01 to about 40, such as from about 1.5 to about 20, such as from about 1.8 to about 10.

Depending upon the thermoplastic polymer, the melt index of the polymer may range from about 0.001 g/10 min to about 1,000 g/10 min, such as from about 0.5 g/10 min to about 800 g/10 min. For example, in one embodiment, the melt index of the thermoplastic resin may be from about 100 g/10 min to about 700 g/10 min.

The thermoplastic resin may also have a relatively low melting point. For instance, the melting point of the thermoplastic resin may be less than about 140° C., such as less than 130° C., such as less than 120° C. For instance, in one embodiment, the melting point may be less than about 90° C. The glass transition temperature of the thermoplastic resin may also be relatively low. For instance, the glass transition temperature may be less than about 50° C., such as less than about 40° C.

The one or more thermoplastic resins may be contained within the additive composition in an amount from about 1% by weight to about 96% by weight. For instance, the thermoplastic resin may be present in the aqueous dispersion in an amount from about 10% by weight to about 70% by weight, such as from about 20% to about 50% by weight.

In addition to at least one thermoplastic resin, the aqueous dispersion may also contain a dispersing agent. A dispersing agent is an agent that aids in the formation and/or the stabilization of the dispersion. One or more dispersing agents may be incorporated into the additive composition.

In general, any suitable dispersing agent can be used. In one embodiment, for instance, the dispersing agent comprises at least one carboxylic acid, a salt of at least one carboxylic acid, or carboxylic acid ester or salt of the carboxylic acid ester. Examples of carboxylic acids useful as a dispersant comprise fatty acids such as montanic acid, stearic acid, oleic acid, and the like. In some embodiments, the carboxylic acid, the salt of the carboxylic acid, or at least one carboxylic acid fragment of the carboxylic acid ester or at least one carboxylic acid fragment of the salt of the carboxylic acid ester has fewer than 25 carbon atoms. In other embodiments, the carboxylic acid, the salt of the carboxylic acid, or at least one carboxylic acid fragment of the carboxylic acid ester or at least one carboxylic acid fragment of the salt of the carboxylic acid ester has 12 to 25 carbon atoms. In some embodiments, carboxylic acids, salts of the carboxylic acid, at least one carboxylic acid fragment of the carboxylic acid ester or its salt has 15 to 25 carbon atoms are preferred. In other embodiments, the number of carbon atoms is 25 to 60. Some examples of salts comprise a cation selected from the group consisting of an alkali metal cation, alkaline earth metal cation, or ammonium or alkyl ammonium cation.

In still other embodiments, the dispersing agent is selected from the group consisting of ethylene-carboxylic acid polymers, and their salts, such as ethylene-acrylic acid copolymers or ethylene-methacrylic acid copolymers.

In other embodiments, the dispersing agent is selected from alkyl ether carboxylates, petroleum sulfonates, sulfonated polyoxyethylenated alcohol, sulfated or phosphated polyoxyethylenated alcohols, polymeric ethylene oxide/propylene oxide/ethylene oxide dispersing agents, primary and secondary alcohol ethoxylates, alkyl glycosides and alkyl glycerides.

When ethylene-acrylic acid copolymer is used as a dispersing agent, the copolymer may also serve as a thermoplastic resin.

In one particular embodiment, the aqueous dispersion contains an ethylene and octene copolymer, ethylene-acrylic acid copolymer, and a fatty acid, such as stearic acid or oleic acid. The dispersing agent, such as the carboxylic acid, may be present in the aqueous dispersion in an amount from about 0.1% to about 10% by weight.

In addition to the above components, the aqueous dispersion also contains water. Water may be added as deionized water, if desired. The pH of the aqueous dispersion is generally less than about 12, such as from about 5 to about 11.5, such as from about 7 to about 11. The aqueous dispersion may have a solids content of less than about 75%, such as less than about 70%. For instance, the solids content of the aqueous dispersion may range from about 5% to about 60%. In general, the solids content can be varied depending upon the manner in which the additive composition is applied or incorporated into the tissue web. For instance, when incorporated into the tissue web during formation, such as by being added with an aqueous suspension of fibers, a relatively high solids content can be used. When topically applied such as by spraying or printing, however, a lower solids content may be used in order to improve processability through the spray or printing device.

While any method may be used to produce the aqueous dispersion, in one embodiment, the dispersion may be formed through a melt-kneading process. For example, the kneader may comprise a Banbury mixer, single-screw extruder or a multi-screw extruder. The melt-kneading may be conducted under the conditions which are typically used for melt-kneading the one or more thermoplastic resins.

In one particular embodiment, the process includes melt-kneading the components that make up the dispersion. The melt-kneading machine may include multiple inlets for the various components. For example, the extruder may include four inlets placed in series. Further, if desired, a vacuum vent may be added at an optional position of the extruder.

In some embodiments, the dispersion is first diluted to contain about 1 to about 3% by weight water and then, subsequently, further diluted to comprise greater than about 25% by weight water.

When treating tissue webs in accordance with the present disclosure, the additive composition containing the aqueous polymer dispersion can be applied to the tissue web topically or can be incorporated into the tissue web by being pre-mixed with the fibers that are used to form the web. When applied topically, the additive composition can be applied to the tissue web when wet or dry. In one embodiment, the additive composition may be applied topically to the web during a creping process. For instance, in one embodiment, the additive composition may be sprayed onto the web or onto a heated dryer drum in order to adhere the web to the dryer drum. The web can then be creped from the dryer drum. When the additive composition is applied to the web and then adhered to the dryer drum, the composition may be uniformly applied over the surface area of the web or may be applied according to a particular pattern.

When topically applied to a tissue web, the additive composition may be sprayed onto the web, extruded onto the web, or printed onto the web. When extruded onto the web, any suitable extrusion device may be used, such as a slot-coat extruder or a meltblown dye extruder. When printed onto the web, any suitable printing device may be used. For example, an inkjet printer or a rotogravure printing device may be used.

In one embodiment, the additive composition may be heated prior to or during application to a tissue web. Heating the composition can lower the viscosity for facilitating application. For instance, the additive composition may be heated to a temperature of from about 50° C. to about 150° C.

Tissue products made according to the present disclosure may include single-ply tissue products or multiple-ply tissue products. For instance, in one embodiment, the product may include two plies or three plies.

In general, any suitable tissue web may be treated in accordance with the present disclosure. For example, in one embodiment, the base sheet can be a tissue product, such as a bath tissue, a facial tissue, a paper towel, an industrial wiper, and the like. Tissue products typically have a bulk density of at least 3 cc/g. The tissue products can contain one or more plies and can be made from any suitable types of fiber.

Fibers suitable for making tissue webs comprise any natural or synthetic cellulosic fibers including, but not limited to nonwoody fibers, such as cotton, abaca, kenaf, sabai grass, flax, esparto grass, straw, jute hemp, bagasse, milkweed floss fibers, and pineapple leaf fibers; and woody or pulp fibers such as those obtained from deciduous and coniferous trees, including softwood fibers, such as northern and southern softwood kraft fibers; hardwood fibers, such as eucalyptus, maple, birch, and aspen. Pulp fibers can be prepared in high-yield or low-yield forms and can be pulped in any known method, including kraft, sulfite, high-yield pulping methods and other known pulping methods. Fibers prepared from organosolv pulping methods can also be used, including the fibers and methods disclosed in U.S. Pat. No. 4,793,898, issued Dec. 27, 1988 to Laamanen et al.; U.S. Pat. No. 4,594,130, issued Jun. 10, 1986 to Chang et al.; and U.S. Pat. No. 3,585,104. Useful fibers can also be produced by anthraquinone pulping, exemplified by U.S. Pat. No. 5,595,628 issued Jan. 21, 1997, to Gordon et al.

A portion of the fibers, such as up to 50% or less by dry weight, or from about 5% to about 30% by dry weight, can be synthetic fibers such as rayon, polyolefin fibers, polyester fibers, bicomponent sheath-core fibers, multi-component binder fibers, and the like. An exemplary polyethylene fiber is Pulpex®, available from Hercules, Inc. (Wilmington, Del.). Any known bleaching method can be used. Synthetic cellulose fiber types include rayon in all its varieties and other fibers derived from viscose or chemically-modified cellulose.

Chemically treated natural cellulosic fibers can be used such as mercerized pulps, chemically stiffened or crosslinked fibers, or sulfonated fibers. For good mechanical properties in using papermaking fibers, it can be desirable that the fibers be relatively undamaged and largely unrefined or only lightly refined. While recycled fibers can be used, virgin fibers are generally useful for their mechanical properties and lack of contaminants. Mercerized fibers, regenerated cellulosic fibers, cellulose produced by microbes, rayon, and other cellulosic material or cellulosic derivatives can be used. Suitable papermaking fibers can also include recycled fibers, virgin fibers, or mixes thereof. In certain embodiments capable of high bulk and good compressive properties, the fibers can have a Canadian Standard Freeness of at least 200, more specifically at least 300, more specifically still at least 400, and most specifically at least 500.

Other papermaking fibers that can be used in the present disclosure include paper broke or recycled fibers and high yield fibers. High yield pulp fibers are those papermaking fibers produced by pulping processes providing a yield of about 65% or greater, more specifically about 75% or greater, and still more specifically about 75% to about 95%. Yield is the resulting amount of processed fibers expressed as a percentage of the initial wood mass. Such pulping processes include bleached chemithermomechanical pulp (BCTMP), chemithermomechanical pulp (CTMP), pressure/pressure thermomechanical pulp (PTMP), thermomechanical pulp (TMP), thermomechanical chemical pulp (TMCP), high yield sulfite pulps, and high yield Kraft pulps, all of which leave the resulting fibers with high levels of lignin. High yield fibers are well known for their stiffness in both dry and wet states relative to typical chemically pulped fibers.

In general, any process capable of forming a paper web can also be utilized in the present disclosure. For example, a papermaking process of the present disclosure can utilize creping, wet creping, double creping, embossing, wet pressing, air pressing, through-air drying, creped through-air drying, uncreped through-air drying, hydroentangling, air laying, as well as other steps known in the art.

The tissue web may be formed from a fiber furnish containing pulp fibers in an amount of at least about 50% by weight, such as at least about 60% by weight, such as at least about 70% by weight, such as at least about 80% by weight, such as at least about 90% by weight, such as 100% by weight.

Also suitable for products of the present disclosure are tissue sheets that are pattern densified or imprinted, such as the tissue sheets disclosed in any of the following U.S. Pat. No. 4,514,345 issued on Apr. 30, 1985, to Johnson et al.; U.S. Pat. No. 4,528,239 issued on Jul. 9, 1985, to Trokhan; U.S. Pat. No. 5,098,522 issued on Mar. 24, 1992; U.S. Pat. No. 5,260,171 issued on Nov. 9, 1993, to Smurkoski et al.; U.S. Pat. No. 5,275,700 issued on Jan. 4, 1994, to Trokhan; U.S. Pat. No. 5,328,565 issued on Jul. 12, 1994, to Rasch et al.; U.S. Pat. No. 5,334,289 issued on Aug. 2, 1994, to Trokhan et al.; U.S. Pat. No. 5,431,786 issued on Jul. 11, 1995, to Rasch et al.; U.S. Pat. No. 5,496,624 issued on Mar. 5, 1996, to Steltjes, Jr. et al.; U.S. Pat. No. 5,500,277 issued on Mar. 19, 1996, to Trokhan et al.; U.S. Pat. No. 5,514,523 issued on May 7, 1996, to Trokhan et al.; U.S. Pat. No. 5,554,467 issued on Sep. 10, 1996, to Trokhan et al.; U.S. Pat. No. 5,566,724 issued on Oct. 22, 1996, to Trokhan et al.; U.S. Pat. No. 5,624,790 issued on Apr. 29, 1997, to Trokhan et al.; and, U.S. Pat. No. 5,628,876 issued on May 13, 1997, to Ayers et al., the disclosures of which are incorporated herein by reference to the extent that they are non-contradictory herewith. Such imprinted tissue sheets may have a network of densified regions that have been imprinted against a drum dryer by an imprinting fabric, and regions that are relatively less densified (e.g., "domes" in the tissue sheet) corresponding to deflection conduits in the imprinting fabric, wherein the tissue sheet superposed over the deflection conduits was deflected by an air pressure differential across the deflection conduit to form a lower-density pillow-like region or dome in the tissue sheet.

The tissue web can also be formed without a substantial amount of inner fiber-to-fiber bond strength. In this regard, the fiber furnish used to form the base web can be treated with a chemical debonding agent. The debonding agent can be added to the fiber slurry during the pulping process or can be added directly to the headbox. Suitable debonding agents that may be used in the present disclosure include cationic debonding agents such as fatty dialkyl quaternary amine salts, mono fatty alkyl tertiary amine salts, primary amine salts, imidazoline quaternary salts, silicone quaternary salt and unsaturated fatty alkyl amine salts. Other suitable debonding agents are disclosed in U.S. Pat. No. 5,529,665 to Kaun which is incorporated herein by reference. In particular, Kaun discloses the use of cationic silicone compositions as debonding agents.

In one embodiment, the debonding agent used in the process of the present disclosure is an organic quaternary ammonium chloride and, particularly, a silicone-based amine salt of a quaternary ammonium chloride. For example, the debonding agent can be PROSOFT® TQ1003, marketed by the Hercules Corporation. The debonding agent can be added to the fiber slurry in an amount of from about 1 kg per metric tonne to about 10 kg per metric tonne of fibers present within the slurry.

In an alternative embodiment, the debonding agent can be an imidazoline-based agent. The imidazoline-based debonding agent can be obtained, for instance, from the Witco Corporation. The imidazoline-based debonding agent can be added in an amount of between 2.0 to about 15 kg per metric tonne.

In one embodiment, the debonding agent can be added to the fiber furnish according to a process as disclosed in PCT Application having an International Publication No. WO 99/34057 filed on Dec. 17, 1998 or in PCT Published Application having an International Publication No. WO 00/66835 filed on Apr. 28, 2000, which are both incorporated herein by reference. In the above publications, a process is disclosed in which a chemical additive, such as a debonding agent, is adsorbed onto cellulosic papermaking fibers at high levels. The process includes the steps of treating a fiber slurry with an excess of the chemical additive, allowing sufficient residence time for adsorption to occur, filtering the slurry to remove unadsorbed chemical additives, and redispersing the filtered pulp with fresh water prior to forming a nonwoven web.

Optional chemical additives may also be added to the aqueous papermaking furnish or to the formed embryonic web to impart additional benefits to the product and process and are not antagonistic to the intended benefits of the invention. The following materials are included as examples of additional chemicals that may be applied to the web along with the additive composition of the present invention. The chemicals are included as examples and are not intended to limit the scope of the invention. Such chemicals may be added at any point in the papermaking process, including being added simultaneously with the additive composition in the pulp making process, wherein said additive or additives are blended directly with the additive composition.

Additional types of chemicals that may be added to the paper web include, but is not limited to, absorbency aids usually in the form of cationic, anionic, or non-ionic surfactants, humectants and plasticizers such as low molecular weight polyethylene glycols and polyhydroxy compounds such as glycerin and propylene glycol. Materials that supply skin health benefits such as mineral oil, aloe extract, vitamin e, silicone, lotions in general and the like may also be incorporated into the finished products.

In general, the products of the present invention can be used in conjunction with any known materials and chemicals that are not antagonistic to its intended use. Examples of such materials include but are not limited to odor control agents, such as odor absorbents, activated carbon fibers and particles, baby powder, baking soda, chelating agents, zeolites, perfumes or other odor-masking agents, cyclodextrin compounds, oxidizers, and the like. Superabsorbent particles, synthetic fibers, or films may also be employed. Additional options include cationic dyes, optical brighteners, humectants, emollients, and the like.

Tissue webs that may be treated in accordance with the present disclosure may include a single homogenous layer of fibers or may include a stratified or layered construction. For instance, the tissue web ply may include two or three layers of fibers. Each layer may have a different fiber composition. For example, referring to FIG. 1, one embodiment of a device for forming a multi-layered stratified pulp furnish is illustrated. As shown, a three-layered headbox 10 generally includes an upper head box wall 12 and a lower head box wall 14. Headbox 10 further includes a first divider 16 and a second divider 18, which separate three fiber stock layers.

Each of the fiber layers comprise a dilute aqueous suspension of papermaking fibers. The particular fibers contained in each layer generally depends upon the product being formed and the desired results. For instance, the fiber composition of each layer may vary depending upon whether a bath tissue product, facial tissue product or paper towel is being produced. In one embodiment, for instance, middle layer 20 contains southern softwood kraft fibers either alone or in combination with other fibers such as high yield fibers. Outer layers 22 and 24, on the other hand, contain softwood fibers, such as northern softwood kraft.

In an alternative embodiment, the middle layer may contain softwood fibers for strength, while the outer layers may comprise hardwood fibers, such as eucalyptus fibers, for a perceived softness.

An endless traveling forming fabric 26, suitably supported and driven by rolls 28 and 30, receives the layered papermaking stock issuing from headbox 10. Once retained on fabric 26, the layered fiber suspension passes water through the fabric as shown by the arrows 32. Water removal is achieved by combinations of gravity, centrifugal force and vacuum suction depending on the forming configuration.

Forming multi-layered paper webs is also described and disclosed in U.S. Pat. No. 5,129,988 to Farrington, Jr., which is incorporated herein by reference.

In accordance with the present disclosure, the additive composition, in one embodiment, may be combined with the aqueous suspension of fibers that are fed to the headbox 10. The additive composition, for instance, may be applied to only a single layer in the stratified fiber furnish or to all layers. When added during the wet end of the process or otherwise combined with the aqueous suspension of fibers, the additive composition becomes incorporated throughout the fibrous layer.

When combined at the wet end with the aqueous suspension of fibers, a retention aid may also be present within the additive composition. For instance, in one particular embodiment, the retention aid may comprise polydiallyl dimethyl ammonium chloride. The additive composition may be incorporated into the tissue web in an amount from about 0.01% to about 30% by weight, such as from about 0.5% to about 20% by weight. For instance, in one embodiment, the additive composition may be present in an amount up to about 10% by weight. The above percentages are based upon the solids that are added to the tissue web.

The basis weight of tissue webs made in accordance with the present disclosure can vary depending upon the final product. For example, the process may be used to produce bath tissues, facial tissues, paper towels, industrial wipers, and the like. In general, the basis weight of the tissue products may vary from about 10 gsm to about 110 gsm, such as from about 20 gsm to about 90 gsm. For bath tissue and facial tissues, for instance, the basis weight may range from about 10 gsm to about 40 gsm. For paper towels, on the other hand, the basis weight may range from about 25 gsm to about 80 gsm.

The tissue web bulk may also vary from about 3 cc/g to 20 cc/g, such as from about 5 cc/g to 15 cc/g. The sheet "bulk" is calculated as the quotient of the caliper of a dry tissue sheet, expressed in microns, divided by the dry basis weight, expressed in grams per square meter. The resulting sheet bulk is expressed in cubic centimeters per gram. More specifically, the caliper is measured as the total thickness of a stack of ten representative sheets and dividing the total thickness of the stack by ten, where each sheet within the stack is placed with the same side up. Caliper is measured in accordance with TAPPI test method T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2.00 kilo-Pascals (132 grams per square inch), a pressure foot area of 2500 square millimeters, a pressure foot diameter of 56.42 millimeters, a dwell time of 3 seconds and a lowering rate of 0.8 millimeters per second.

In multiple ply products, the basis weight of each tissue web present in the product can also vary. In general, the total basis weight of a multiple ply product will generally be the same as indicated above, such as from about 20 gsm to about 110 gsm. Thus, the basis weight of each ply can be from about 10 gsm to about 60 gsm, such as from about 20 gsm to about 40 gsm.

Figure 2:
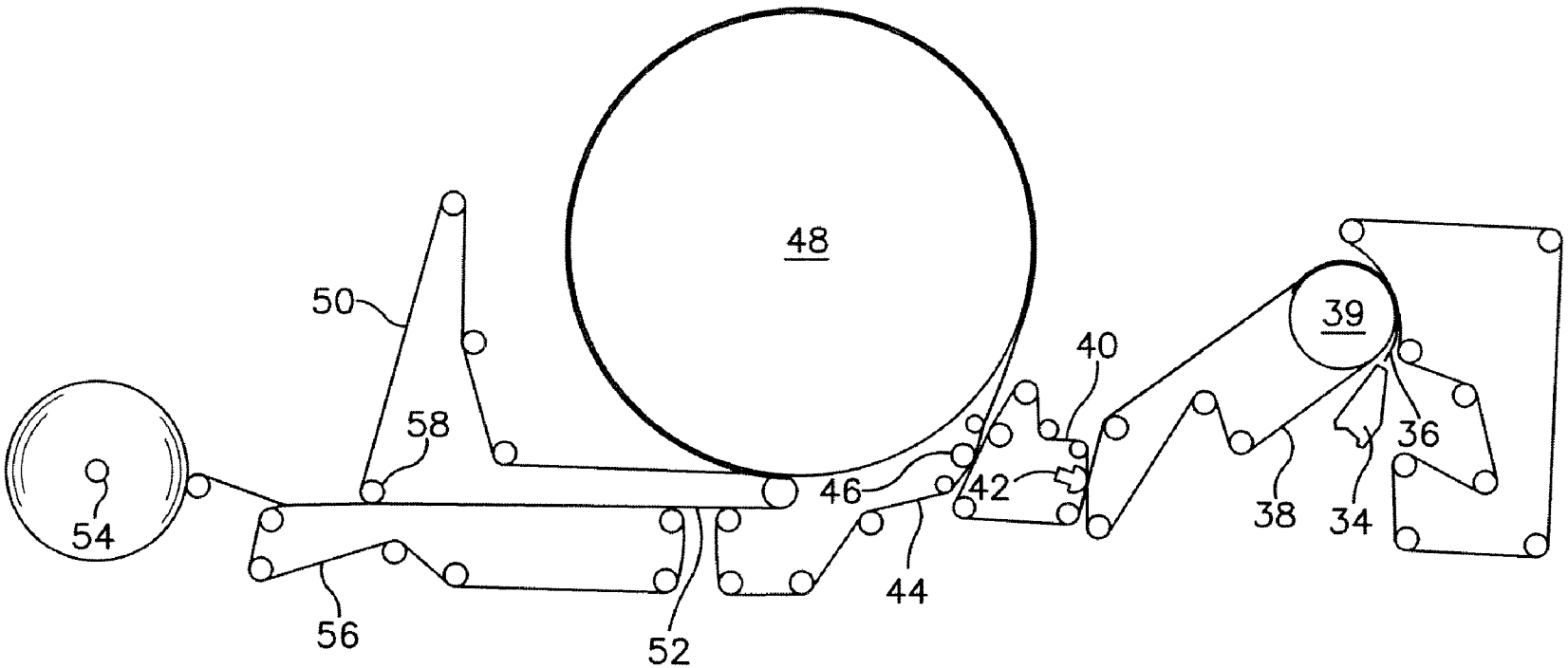
FIG. 2 is a schematic diagram of one embodiment of a process for forming uncreped through-dried tissue webs for use in the present disclosure.

Once the aqueous suspension of fibers is formed into a tissue web, the tissue web may be processed using various techniques and methods. For example, referring to FIG. 2, shown is a method for making throughdried tissue sheets. (For simplicity, the various tensioning rolls schematically used to define the several fabric runs are shown, but not numbered. It will be appreciated that variations from the apparatus and method illustrated in FIG. 2 can be made without departing from the general process). Shown is a twin wire former having a papermaking headbox 34, such as a layered headbox, which injects or deposits a stream 36 of an aqueous suspension of papermaking fibers onto the forming fabric 38 positioned on a forming roll 39. The forming fabric serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric to a transfer fabric 40. In one embodiment, the transfer fabric can be traveling at a slower speed than the forming fabric in order to impart increased stretch into the web. This is commonly referred to as a "rush" transfer. Preferably the transfer fabric can have a void volume that is equal to or less than that of the forming fabric. The relative speed difference between the two fabrics can be from 0-60 percent, more specifically from about 15-45 percent. Transfer is preferably carried out with the assistance of a vacuum shoe 42 such that the forming fabric and the transfer fabric simultaneously converge and diverge at the leading edge of the vacuum slot.

The web is then transferred from the transfer fabric to the throughdrying fabric 44 with the aid of a vacuum transfer roll 46 or a vacuum transfer shoe, optionally again using a fixed gap transfer as previously described. The throughdrying fabric can be traveling at about the same speed or a different speed relative to the transfer fabric. If desired, the throughdrying fabric can be run at a slower speed to further enhance stretch. Transfer can be carried out with vacuum assistance to ensure deformation of the sheet to conform to the throughdrying fabric, thus yielding desired bulk and appearance if desired. Suitable throughdrying fabrics are described in U.S. Pat. No. 5,429,686 issued to Kai F. Chiu et al. and U.S. Pat. No. 5,672,248 to Wendt, et al. which are incorporated by reference.

In one embodiment, the throughdrying fabric contains high and long impression knuckles. For example, the throughdrying fabric can have about from about 5 to about 300 impression knuckles per square inch which are raised at least about 0.005 inches above the plane of the fabric. During drying, the web can be macroscopically arranged to conform to the surface of the throughdrying fabric and form a three-dimensional surface. Flat surfaces, however, can also be used in the present disclosure.

The side of the web contacting the throughdrying fabric is typically referred to as the "fabric side" of the paper web. The fabric side of the paper web, as described above, may have a shape that conforms to the surface of the throughdrying fabric after the fabric is dried in the throughdryer. The opposite side of the paper web, on the other hand, is typically referred to as the "air side". The air side of the web is typically smoother than the fabric side during normal throughdrying processes.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

While supported by the throughdrying fabric, the web is finally dried to a consistency of about 94 percent or greater by the throughdryer 48 and thereafter transferred to a carrier fabric 50. The dried basesheet 52 is transported to the reel 54 using carrier fabric 50 and an optional carrier fabric 56. An optional pressurized turning roll 58 can be used to facilitate transfer of the web from carrier fabric 50 to fabric 56. Suitable carrier fabrics for this purpose are Albany International 84M or 94M and Asten 959 or 937, all of which are relatively smooth fabrics having a fine pattern. Although not shown, reel calendering or subsequent off-line calendering can be used to improve the smoothness and softness of the basesheet.

In one embodiment, the reel 54 shown in FIG. 2 can run at a speed slower than the fabric 56 in a rush transfer process for building crepe into the paper web 52. For instance, the relative speed difference between the reel and the fabric can be from about 5% to about 25% and, particularly from about 12% to about 14%. Rush transfer at the reel can occur either alone or in conjunction with a rush transfer process upstream, such as between the forming fabric and the transfer fabric.

In one embodiment, the paper web 52 is a textured web which has been dried in a three-dimensional state such that the hydrogen bonds joining fibers were substantially formed while the web was not in a flat, planar state. For instance, the web can be formed while the web is on a highly textured throughdrying fabric or other three-dimensional substrate. Processes for producing uncreped throughdried fabrics are, for instance, disclosed in U.S. Pat. No. 5,672,248 to Wendt, et al.; U.S. Pat. No. 5,656,132 to Farrington, et al.; U.S. Pat. No. 6,120,642 to Lindsay and Burazin; U.S. Pat. No. 6,096,169 to Hermans, et al.; U.S. Pat. No. 6,197,154 to Chen, et al.; and U.S. Pat. No. 6,143,135 to Hada, et al., all of which are herein incorporated by reference in their entireties.

As described above, the additive composition can be combined with the aqueous suspension of fibers used to form the tissue web 52. Alternatively, the additive composition may be topically applied to the tissue web after it has been formed. For instance, as shown in FIG. 2, the additive composition may be applied to the tissue web prior to the dryer 48 or after the dryer 48.

In FIG. 2, a process is shown for producing uncreped through-air dried tissue webs. It should be understood, however, that the additive composition may be applied to tissue webs in other tissue making processes. For example, referring to FIG. 3, one embodiment of a process for forming wet creped tissue webs is shown. In this embodiment, a headbox 60 emits an aqueous suspension of fibers onto a forming fabric 62 which is supported and driven by a plurality of guide rolls 64. A vacuum box 66 is disposed beneath forming fabric 62 and is adapted to remove water from the fiber furnish to assist in forming a web. From forming fabric 62, a formed web 68 is transferred to a second fabric 70, which may be either a wire or a felt. Fabric 70 is supported for movement around a continuous path by a plurality of guide rolls 72. Also included is a pick up roll 74 designed to facilitate transfer of web 68 from fabric 62 to fabric 70.

From fabric 70, web 68, in this embodiment, is transferred to the surface of a rotatable heated dryer drum 76, such as a Yankee dryer.

In accordance with the present disclosure, the additive composition can be incorporated into the tissue web 68 by being combined with an aqueous suspension of fibers contained in the headbox 60 and/or by topically applying the additive composition during the process. In one particular embodiment, the additive composition of the present disclosure may be applied topically to the tissue web 68 while the web is traveling on the guide rolls 72 or may be applied to the surface of the dryer drum 76 for transfer onto one side of the tissue web 68. In this manner, the additive composition is used to adhere the tissue web 68 to the dryer drum 76. In this embodiment, as web 68 is carried through a portion of the rotational path of the dryer surface, heat is imparted to the web causing most of the moisture contained within the web to be evaporated. Web 68 is then removed from dryer drum 76 by a creping blade 78. Creping web 78 as it is formed further reduces internal bonding within the web and increases softness. Applying the additive composition to the web during creping, on the other hand, may increase the strength of the web.

In addition to applying the additive composition during formation of the tissue web, the additive composition may also be used in post-forming processes. For example, in one embodiment, the additive composition may be used during a print-creping process. Specifically, once topically applied to a tissue web, the additive composition has been found well-suited to adhering the tissue web to a creping surface, such as in a print-creping operation.

For example, once a tissue web is formed and dried, in one embodiment, the additive composition may be applied to at least one side of the web and the at least one side of the web may then be creped. In general, the additive composition may be applied to only one side of the web and only one side of the web may be creped, the additive composition may be applied to both sides of the web and only one side of the web is creped, or the additive composition may be applied to each side of the web and each side of the web may be creped.

Figure 3:
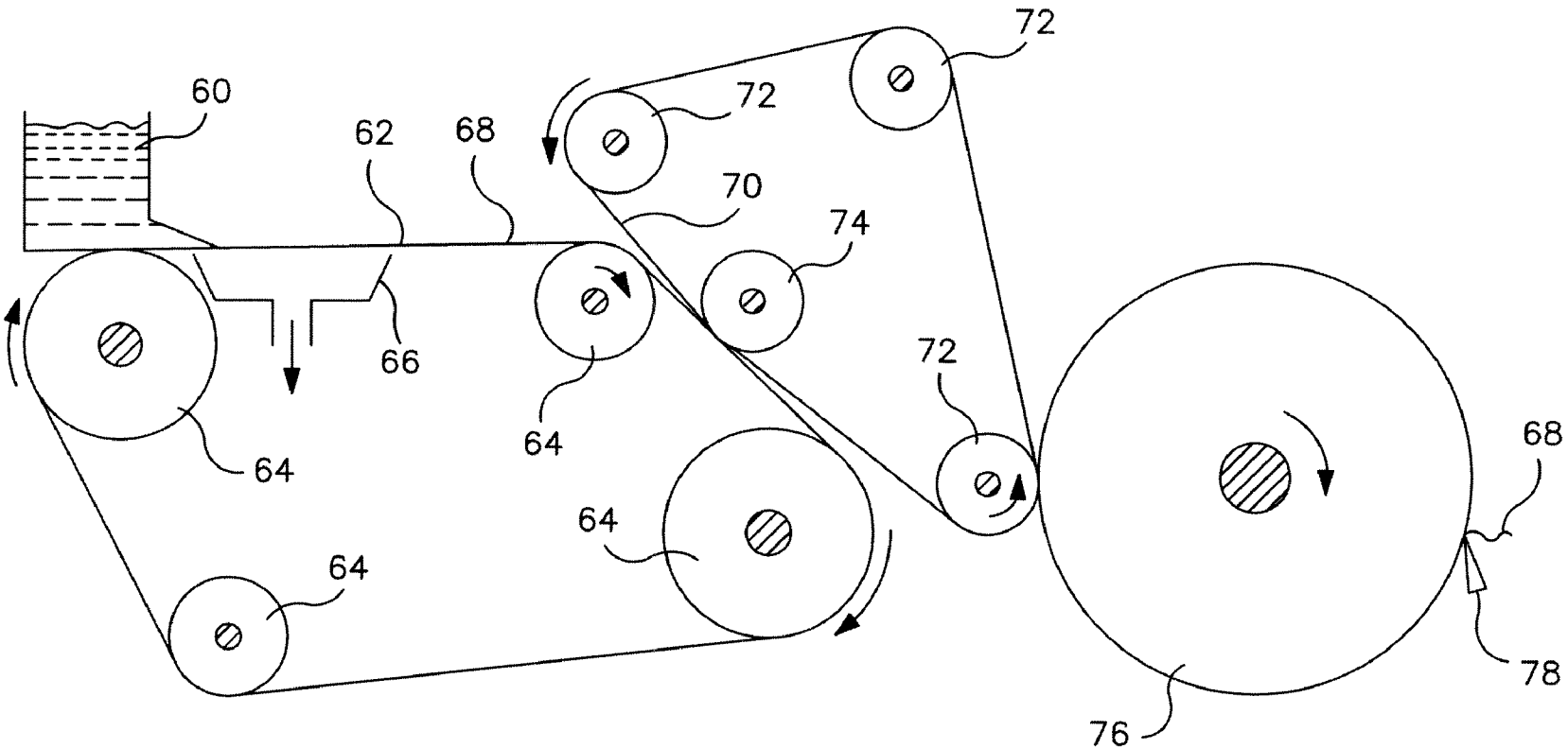
FIG. 3 is a schematic diagram of one embodiment of a process for forming wet creped tissue webs for use in the present disclosure.
Figure 4:
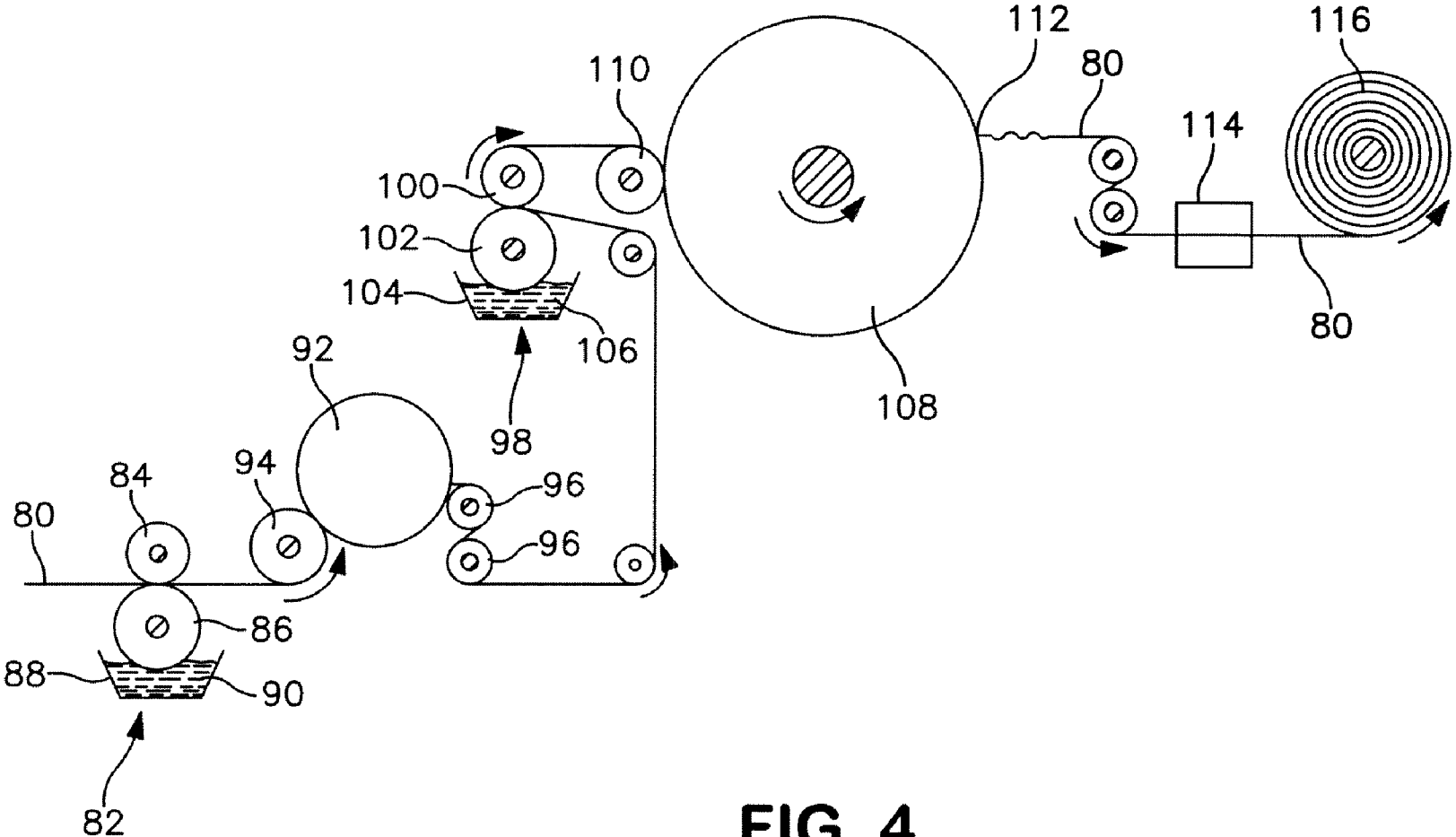
FIG. 4 is a schematic diagram of one embodiment of a process for applying additive compositions to each side of a tissue web and creping one side of the web in accordance with the present disclosure.

Referring to FIG. 4, one embodiment of a system that may be used to apply the additive composition to the tissue web and to crepe one side of the web is illustrated. The embodiment shown in FIG. 4 can be an in-line or off-line process. As shown, tissue web 80 made according to the process illustrated in FIG. 2 or FIG. 3 or according to a similar process, is passed through a first additive composition application station generally 82. Station 82 includes a nip formed by a smooth rubber press roll 84 and a patterned rotogravure roll 86. Rotogravure roll 86 is in communication with a reservoir 88 containing a first additive composition 90. Rotogravure roll 86 applies the additive composition 90 to one side of web 80 in a preselected pattern.

Web 80 is then contacted with a heated roll 92 after passing a roll 94. The heated roll 92 can be heated to a temperature, for instance, up to about 200° C. and particularly from about 100° C. to about 150° C. In general, the web can be heated to a temperature sufficient to dry the web and evaporate any water.

It should be understood, that the besides the heated roll 92, any suitable heating device can be used to dry the web. For example, in an alternative embodiment, the web can be placed in communication with an infra-red heater in order to dry the web. Besides using a heated roll or an infra-red heater, other heating devices can include, for instance, any suitable convective oven or microwave oven.

From the heated roll 92, the web 80 can be advanced by pull rolls 96 to a second additive composition application station generally 98. Station 98 includes a transfer roll 100 in contact with a rotogravure roll 102, which is in communication with a reservoir 104 containing a second additive composition 106. Similar to station 82, second additive composition 106 is applied to the opposite side of web 80 in a preselected pattern. Once the second additive composition is applied, web 80 is adhered to a creping roll 108 by a press roll 110. Web 80 is carried on the surface of the creping drum 108 for a distance and then removed therefrom by the action of a creping blade 112. The creping blade 112 performs a controlled pattern creping operation on the second side of the tissue web.

Once creped, tissue web 80, in this embodiment, is pulled through a drying station 114. Drying station 114 can include any form of a heating unit, such as an oven energized by infra-red heat, microwave energy, hot air or the like. Drying station 114 may be necessary in some applications to dry the web and/or cure the additive composition. Depending upon the additive composition selected, however, in other applications drying station 114 may not be needed.

The amount that the tissue web is heated within the drying station 114 can depend upon the particular thermoplastic resins used in the additive composition, the amount of the composition applied to the web, and the type of web used. In some applications, for instance, the tissue web can be heated using a gas stream such as air at a temperature of about 100° C. to about 200° C.

In the embodiment illustrated in FIG. 4, although the additive composition is being applied to each side of the tissue web, only one side of the web undergoes a creping process. It should be understood, however, that in other embodiments both sides of the web may be creped. For instance, the heated roll 92 may be replaced with a creping drum such as 108 shown in FIG. 4.

Creping the tissue web as shown in FIG. 4 increases the softness of the web by breaking apart fiber-to-fiber bonds contained within the tissue web. Applying the additive composition to the outside of the paper web, on the other hand, not only assists in creping the web but also adds dry strength, wet strength, stretchability and tear resistance to the web. Further, the additive composition reduces the release of lint from the tissue web.

In general, the first additive composition and the second additive composition applied to the tissue web as shown in FIG. 4 may contain the same ingredients or may contain different ingredients. Alternatively, the additive compositions may contain the same ingredients in different amounts as desired.

The additive composition is applied to the base web as described above in a preselected pattern. In one embodiment, for instance, the additive composition can be applied to the web in a reticular pattern, such that the pattern is interconnected forming a net-like design on the surface.

In an alternative embodiment, however, the additive composition is applied to the web in a pattern that represents a succession of discrete shapes. Applying the additive composition in discrete shapes, such as dots, provides sufficient strength to the web without covering a substantial portion of the surface area of the web.

According to the present disclosure, the additive composition is applied to each side of the paper web so as to cover from about 15% to about 75% of the surface area of the web. More particularly, in most applications, the additive composition will cover from about 20% to about 60% of the surface area of each side of the web. The total amount of additive composition applied to each side of the web can be in the range of from about 1% to about 30% by weight, based upon the total weight of the web, such as from about 1% to about 20% by weight, such as from about 2% to about 10% by weight.

At the above amounts, the additive composition can penetrate the tissue web after being applied in an amount up to about 30% of the total thickness of the web, depending upon various factors. It has been discovered, however, that most of the additive composition primarily resides on the surface of the web after being applied to the web. For instance, in some embodiments, the additive composition penetrates the web less than 5%, such as less than 3%, such as less than 1% of the thickness of the web.

Figure 5:
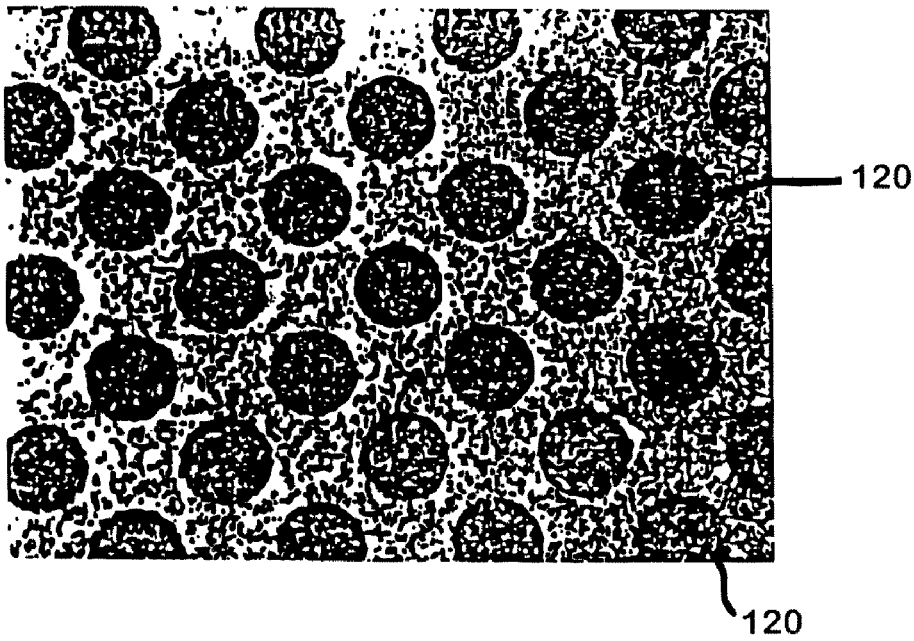
FIG. 5 is a plan view of one embodiment of a pattern that is used to apply additive compositions to tissue webs made in accordance with the present disclosure.

Referring to FIG. 5, one embodiment of a pattern that can be used for applying an additive composition to a paper web in accordance with the present disclosure is shown. As illustrated, the pattern shown in FIG. 5 represents a succession of discrete dots 120. In one embodiment, for instance, the dots can be spaced so that there are approximately from about 25 to about 35 dots per inch in the machine direction or the cross-machine direction. The dots can have a diameter, for example, of from about 0.01 inches to about 0.03 inches. In one particular embodiment, the dots can have a diameter of about 0.02 inches and can be present in the pattern so that approximately 28 dots per inch extend in either the machine direction or the cross-machine direction. In this embodiment, the dots can cover from about 20% to about 30% of the surface area of one side of the paper web and, more particularly, can cover about 25% of the surface area of the web.

Figure 7:
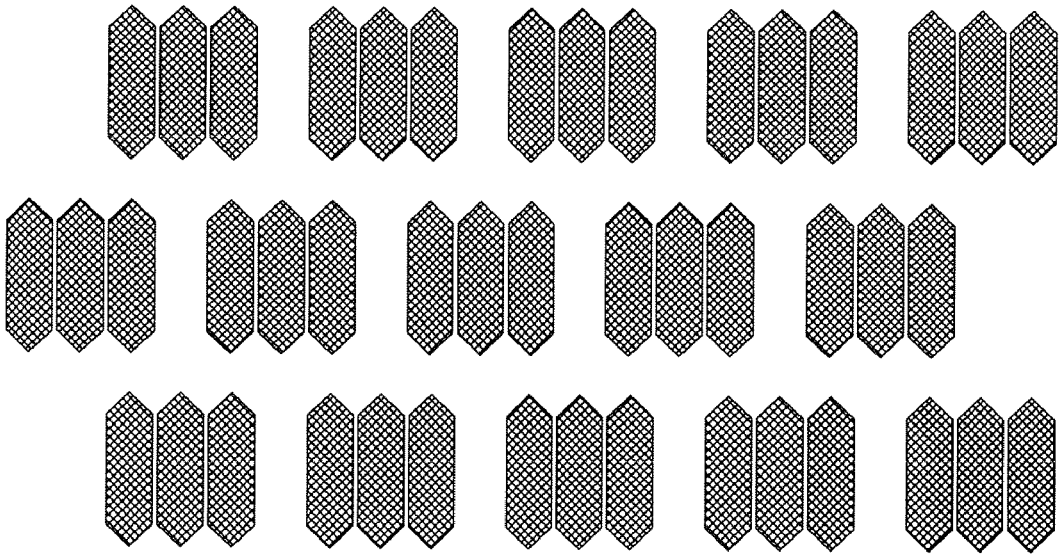
FIG. 7 is a plan view of another alternative embodiment of a pattern that is used to apply additive compositions to tissue webs in accordance with the present disclosure.

Besides dots, various other discrete shapes can also be used. For example, as shown in FIG. 7, a pattern is illustrated in which the pattern is made up of discrete shapes that are each comprised of three elongated hexagons. In one embodiment, the hexagons can be about 0.02 inches long and can have a width of about 0.006 inches. Approximately 35 to 40 hexagons per inch can be spaced in the machine direction and the cross-machine direction. When using hexagons as shown in FIG. 7, the pattern can cover from about 40% to about 60% of the surface area of one side of the web, and more particularly can cover about 50% of the surface area of the web.

Figure 6:
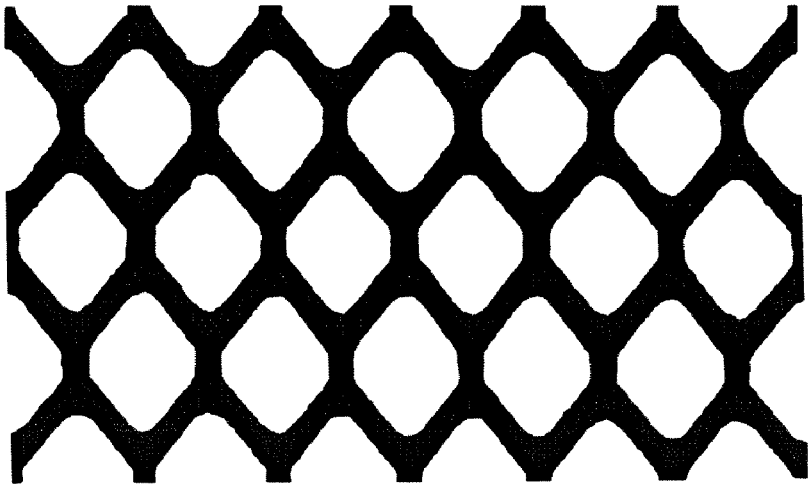
FIG. 6 is another embodiment of a pattern that is used to apply additive compositions to tissue webs in accordance with the present disclosure.

Referring to FIG. 6, another embodiment of a pattern for applying an additive composition to a paper web is shown. In this embodiment, the pattern is a reticulated grid. More specifically, the reticulated pattern is in the shape of diamonds. When used, a reticulated pattern may provide more strength to the web in comparison to patterns that are made up on a succession of discrete shapes.

The process that is used to apply the additive composition to the tissue web in accordance with the present disclosure can vary. For example, various printing methods can be used to print the additive composition onto the base sheet depending upon the particular application. Such printing methods can include direct gravure printing using two separate gravures for each side, offset gravure printing using duplex printing (both sides printed simultaneously) or station-to-station printing (consecutive printing of each side in one pass). In another embodiment, a combination of offset and direct gravure printing can be used. In still another embodiment, flexographic printing using either duplex or station-to-station printing can also be utilized to apply the additive composition.

Figure 8:
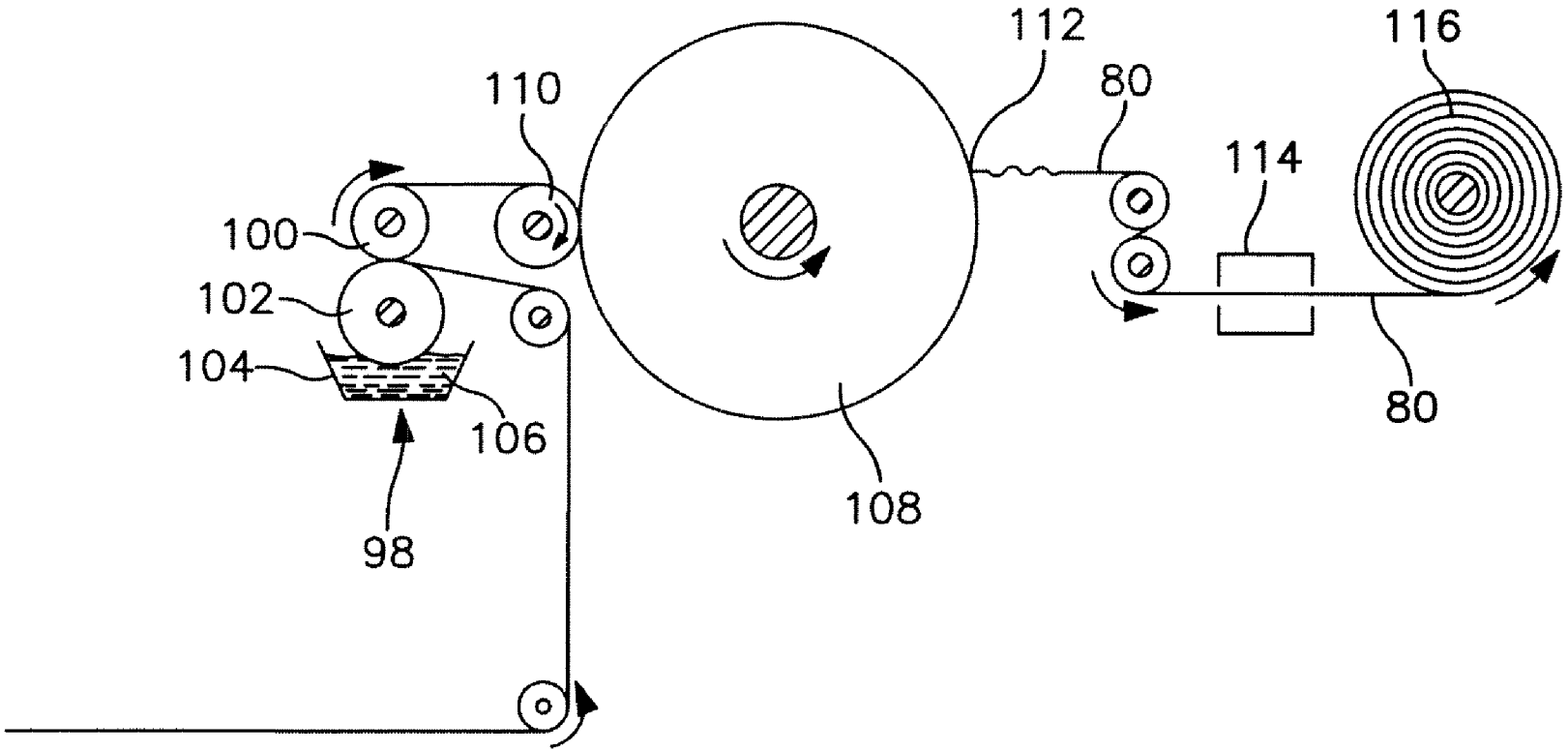
FIG. 8 is a schematic diagram of an alternative embodiment of a process for applying an additive composition to one side of the tissue web and creping one side of the web in accordance with the present disclosure.

Referring to FIG. 8, another alternative embodiment for printing the additive composition onto a tissue web in order to crepe the web is illustrated. In this embodiment, in comparison to the embodiment illustrated in FIG. 4, the additive composition is only applied to one side of the tissue web. Like reference numerals have been used to indicate similar elements.

As shown, a web 80 is advanced to an additive composition application station generally 98. Station 98 includes a transfer roll 100 in contact with a rotogravure roll 102, which is in communication with a reservoir 104 containing an additive composition 106. At station 98, the additive composition 106 is applied to one side of the web 80 in a preselected pattern.

Once the additive composition is applied, web 80 is adhered to a creping roll 108 by a press roll 110. Web 80 is carried on the surface of the creping drum 108 for a distance and then removed therefrom by the action of a creping blade 112. The creping blade 112 performs a controlled pattern creping operation on the treated side of the web.

From the creping drum 108, the tissue web 80 is fed through a drying station 114 which dries and/or cures the additive composition 106. The web 80 is then wound into a roll 116 for use in forming multiple ply products.

When only treating one side of the tissue web 80 with an additive composition, in one embodiment, it may be desirable to apply the additive composition according to a pattern that covers greater than about 40% of the surface area of one side of the web. For instance, the pattern may cover from about 40% to about 60% of the surface area of one side of the web. In one particular example, for instance, the additive composition can be applied according to the pattern shown in FIG. 7.

Tissue webs incorporating the additive composition as described in any of the above embodiments generally have a bulk of greater than about 3 cc/g, such as greater than about 8 cc/g, such as greater than about 10 cc/g, such as even greater than about 11 cc/g. The tissue webs may have a basis weight of from about 6 gsm to about 110 gsm or greater. For instance, the basis weight of the tissue webs can range from about 10 gsm to about 40 gsm in one embodiment or, alternatively, from about 20 gsm to about 80 gsm.

Once a tissue web is produced according to one of the above described processes incorporating the additive composition, in accordance with the present disclosure, the web can be embossed, crimped, and/or laminated with other webs by applying pressure and/or heat to the web containing the additive composition. During the process, the additive composition can form embossments in the product and/or can form bond areas for bonding the tissue web to other adjacent webs. Use of the additive composition enhances the embossing, crimping or lamination process in several ways. For instance, the embossed pattern can be much more defined due to the presence of the additive composition. Further, the embossing is not only water resistant but, unexpectedly, it has been discovered that a tissue web containing the additive composition can be embossed without substantially weakening the web. In particular, it has been discovered that a tissue web containing the additive composition can be embossed without reducing the tensile strength of the web in either the machine direction or the cross machine direction by more than about 5%. In fact, in some embodiments, the tensile strength of the web may actually be increased after the embossing process.

Figure 9:
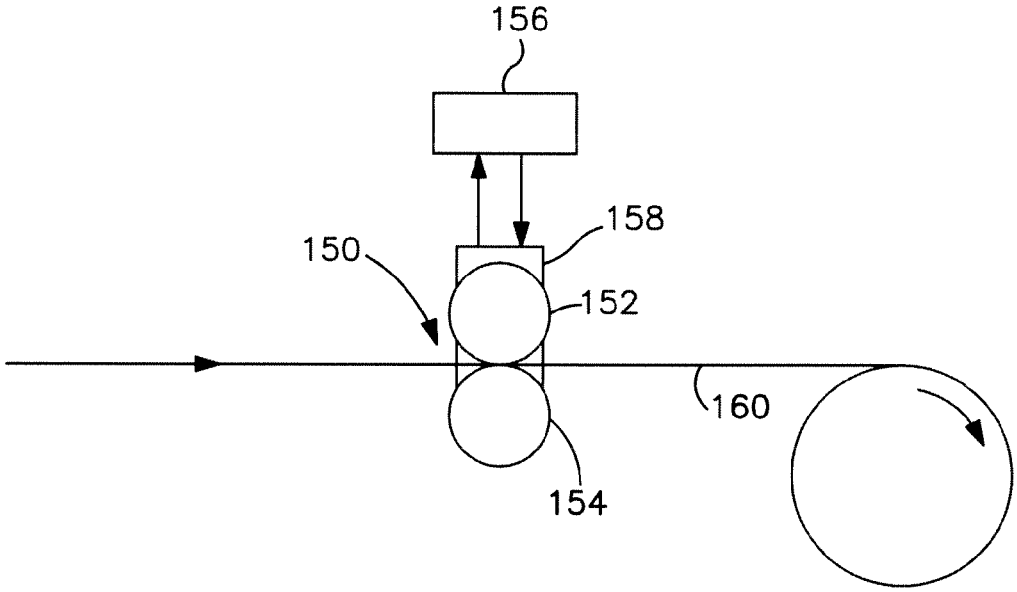
FIG. 9 is a side view of one embodiment of a process for embossing a tissue product in accordance with the present disclosure.

For purposes of illustration, one embodiment of a process for embossing a tissue web according to the present disclosure is illustrated in FIG. 9. As shown in the figure, a tissue web 160 can be fed into an embossing nip 150. In the embodiment illustrated in FIG. 9, only a single tissue web is embossed. It should be understood, however, that in other embodiments multiple webs may be fed into the embossing nip 150 for forming a multi-ply product. For example, the separate plies of the multi-ply product can be brought adjacent to one another from separate parent rolls or directly from separate production lines placed upstream of the embossing nip 150.

When forming multiple ply products, the resulting tissue product may comprise two plies, three plies, or more. Each adjacent ply may contain the additive composition or at least one of the plies adjacent to one another may contain the additive composition. The individual plies can generally be made from the same or from a different fiber furnish and can be made from the same or a different process.

The moisture content of the tissue web 160 as it enters the embossing nip 150 may vary depending upon the particular application and the process conditions. For example, in one embodiment, the tissue web can be fairly dry when entering the embossing nip. The moisture content of the tissue web, for instance, can be less than about 10% by weight of the web, such as less than about 8% by weight of the web, such as less than about 5% by weight of the web.

The embossing nip 150 is formed between a pattern roll 152 and a backing roll 154. The embossing nip 150 is configured to apply sufficient pressure and/or heat in order to cause the thermoplastic polymer contained within the additive composition to soften. By softening the polymer, the polymer flows within the tissue web and forms defined embossments. Further, when feeding multiple plies into the embossing nip, the additive composition forms bond areas which laminates the plies together. In general, the pattern roll 152 and/or the backing roll 154 may be maintained at a temperature of from ambient up to about 150° C., such as from about 50° C. to about 90° C. The pressure exerted on the tissue web within the nip 150 may vary depending upon whether or not one or more of the rolls is heated. In general, the nip pressure can be from about 200 psi to about 500 psi, such as from about 250 psi to about 350 psi.

Residence time of the one or more tissue webs within the embossing nip 150 can also vary depending upon various factors, such as the line speed as well as the roll diameters. In general, the residence time of the tissue web in the embossing nip 150 can be from about 2 milliseconds to about 100 milliseconds, such as from about 2 milliseconds to about 25 milliseconds. In general, the longer the residence time in the embossing nip 150, the lower the pressure and temperature required in order to obtain the desired amount of defined embossments.

In the embodiment shown in FIG. 9, the pattern roll 152 is heated during the embossing process. For example, a liquid such as oil can be heated in a remote chamber 156 and continuously circulated via a control valve 158 to route the oil along the interior surface of the pattern roll 152.

It should be understood, however, that various other methods of heating the pattern roll 152 and/or the backing roll 154 may be employed. For example, the rolls may be heated by circulating a supply of heated water, gas, steam or the like. Alternatively, rather than circulating a heated fluid within one of the rolls, the rolls may be heated by an electrical heat generating device or by way of induction heating. Other suitable methods of providing thermal energy to the embossing nip 150 may include infrared, radiant or a conductive heat generating device. A combination of heating methods can also be employed.

Additionally, the tissue web 160 may be preheated prior to entering the embossing nip 150. For instance, the tissue web may be preheated by guiding the web around a heated roll prior to entering the embossing nip 150.

In still another embodiment, the additive composition of the present disclosure may be topically applied to the tissue web 160 just prior to the web entering the embossing nip 150. In this manner, the additive composition may be heated and thus can already be in a softened state prior to entering the embossing nip 150.

The backing roll 154 can be any suitable backing roll which can support the nip pressure necessary to suitably emboss the tissue web 160 under the desired process conditions. The backing roll 154, for instance, may comprise a rubber coated backing roll. For instance, the backing roll 154 can include a rigid inner shell covered by a resilient elastomeric material. The elastomeric material covering the resilient roll may be any suitable material, such as, for example, a polyurethane.

Alternatively, the backing roll 154 can be a mated steel roll having a pattern that matches the pattern on the pattern roll 152. In still another embodiment, the backing roll 154 can comprise a smooth steel roll, commonly referred to as an anvil roll.

The process of the present disclosure can be used to simply emboss a decorative pattern into the tissue web 160. Alternatively, the presence of the additive composition in the tissue web 160 can be used to bond the tissue web to an adjacent ply in order to form a multi-ply product.

In one embodiment, a visible pattern may be embossed into the tissue web 160. For instance, the pattern roll 152 can include raised pattern elements. The pattern elements can form any desired decorative pattern in the tissue web. The decorative pattern can be visually recognizable and aesthetically pleasing. The decorative pattern can include straight lines, curved lines, flowers, butterflies, leaves, animals, toys, monograms, words, symbols and the like. The pattern can be made up of separate discrete shapes or can comprise a reticulated grid. The pattern may also comprise a combination of a reticulated pattern and discrete shapes. In general, the pattern can cover between about 1% and about 80% of the surface area of the sheet, such as from about 2% to about 60% of the surface area of the sheet. For example, in one embodiment, the embossing pattern can cover from about 5% to about 30% of the surface area of the sheet.

Figure 10:
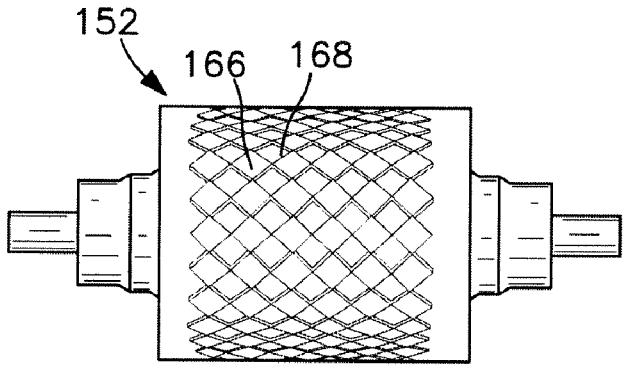
FIG. 10 is a perspective view of an embossing roller that may be used to emboss tissue webs in accordance with the present disclosure.

One possible embodiment of a pattern roll 152 is shown in greater detail in FIG. 10. The pattern roll 152 can be, for instance, a rigid steel roll with the pattern elements formed by engraving or other suitable techniques. As can be seen, the surface of the pattern roll 152 includes reticulated raised bonding elements 168 that are separated by smooth land areas 166. The raised bonding elements 168 are desirably arranged to form a decorative pattern, though the elements can alternatively be discrete elements arranged in a random fashion. The bonding elements 168 can be raised above the surface of the land areas 166 a distance such that the pressure in the embossing nip 150 at the intimate areas of contact between the bonding elements 168 and the tissue web 160 are sufficient to emboss the tissue web as desired. Generally, the bonding elements 168 are raised above the land areas 166 at least about 0.01 inch and particularly from about 0.02 inch to about 0.06 inch.

Figure 11:
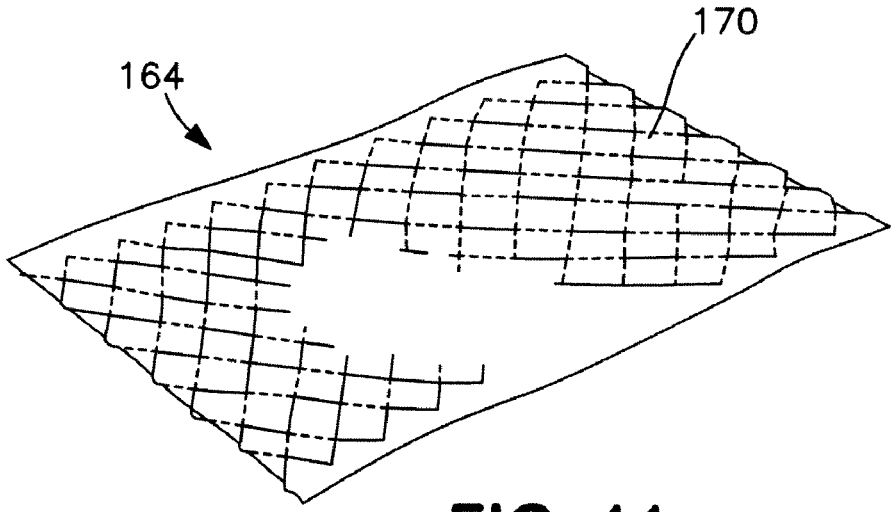
FIG. 11 is a perspective view of one embodiment of a tissue product made in accordance with the present disclosure.

Referring to FIG. 11, a tissue product 164 is shown that is intended to represent a tissue product that may be formed in conjunction with use of the pattern roll 152 as shown in FIG. 10. The tissue product represented in FIG. 11 may be a single ply product or may comprise a multi-ply product. As shown, the pattern roll 152 forms well defined embossments within the tissue web 164. The embossments are well defined due to the presence of the additive composition. When the tissue product 164 comprises a multi-ply tissue product, the embossments 170 also comprise bond areas where the multiple plies are held together by the additive composition.

Numerous and different tissue products can be formed according to the above process. The tissue product can be, for instance, a facial tissue, a bath tissue, a paper towel, a napkin, an industrial wiper, and the like.

The present disclosure may be better understood with reference to the following examples.

Example No. 1

A tissue web was constructed and topically treated with an additive composition made in accordance with the present disclosure. The tissue web was then subjected to an embossing process similar to the one illustrated in FIG. 9. During the embossing process, a pattern roll was heated to a temperature of approximately 80° C. The strength of the embossed tissue web was then compared with the strength of the tissue web prior to embossing.

Tissue Basesheets

The following process was used to produce a 3-layer uncreped through-air dried base web in a process similar to the process shown in FIG. 2. The basesheet had a basis weight of about 30 gsm.

Air-dried northern softwood kraft (NSWK) pulp from the Terrace Bay, ON, Canada mill of Neenah Paper Inc. was placed into a pulper and disintegrated for 30 minutes at 4% consistency at 120 degrees Fahrenheit. The NSWK pulp was then transferred to a dump chest and subsequently diluted to approximately 3% consistency. The NSWK pulp was diluted to about 2% consistency, pumped to a machine chest and diluted with fresh water to reduce the machine chest consistency to about 0.2-0.3%.

Air-dried Aracruz ECF, a eucalyptus hardwood Kraft (EHWK) pulp available from Aracruz, located in Rio de Janeiro, R J, Brazil, was placed into a pulper and disintegrated for 30 minutes at about 4% consistency at 120 degrees Fahrenheit. The EHWK pulp was then transferred to a dump chest and subsequently diluted to about 2% consistency.

Next, the EHWK pulp slurry was diluted, divided into two equal amounts, and pumped at about 1% consistency into two separate machine chests. This pulp slurry was subsequently diluted to about 0.1% consistency. The two EHWK pulp fibers represent the two outer layers of the 3-layered tissue structure.

Approximately 2 kilograms per metric ton of wood fiber PAREZ® 631 NC, available from LANXESS Corporation, located in Trenton, N.J., U.S.A, was added to the stuff boxes, mixing with the pulp fibers before pumping the pulp slurry through the headbox. The pulp fibers from all three machine chests were pumped to the headbox at a consistency of about 0.1%. Pulp fibers from each machine chest were sent through separate manifolds in the headbox to create a 3-layered tissue structure. The fibers were deposited on a forming fabric. Water was removed by vacuum.

The wet sheet, about 10-15% consistency, was transferred to a transfer fabric that was moving approximately 28% slower than the forming fabric. The basesheet was then dewatered to about 15-25% consistency and transferred to an additional fabric. The sheet and fabric were dried utilizing hot air of approximately 400 degrees F. in a through dryer and wound into soft rolls for converting.

Chemical Application Process

The uncreped through air-dried tissue sheet was coated with a chemical composition utilizing 2 rotogravure printers in a typical printing process described as a print-print application.

The printing process consisted of the tissue web being fed into a gravure printing line where the additive composition was printed onto the surface of the sheet. One side of the sheet was printed using direct rotogravure printing. The sheet was printed with a 0.020 diameter "dot" pattern as shown in FIG. 5 wherein 28 dots per inch were printed on the sheet in both the machine and cross-machine directions. The resulting surface area coverage was approximately 25%. The solids of the solution being printed were controlled to approximately 30% to provide a 5% dry polymer add-on per dry tissue weight per printed side. The sheet traveled from the first print station to a second identical print station where the second side of the tissue was coated in a similar fashion. The sheet was then passed through a throughdryer that dried the printed web to approximately 95% solids utilizing an air temperature of approximately 120° C.

Chemical Applied

The samples were treated with an additive composition made in accordance with the present disclosure. The poly olefin dispersion consisted of 70% of the polymer designated as "PBPE"—an experimental propylene-based plastomer or elastomer ("PBPE") having a density of 0.867 grams/cm$^3$ as measured by ASTM D792, a melt flow rate of 25 g/10 min. at 230° C. and 2.16 kg as measured by ASTM D1238, and an ethylene content of 12% by weight of the PBPE and 30 wt % of PRIMACOR™ 5980i copolymer. The PRIMACOR™ 5980i copolymer is an ethylene-acrylic acid copolymer obtained from The Dow Chemical Company and has a Melt Index of 13.75 g/10 min at 125C per 2.16 kg following ASTM D1238. The ethylene-acrylic acid copolymer can serve not only as a thermoplastic polymer but also as a dispersing agent. The dispersion also contained DOWICIL™ 200 antimicrobial obtained from The Dow Chemical Company, which is a preservative with the active composition of 96% cis 1-(3-chloroallyl)-3,5,7-triaza-1-azoniaadamantane chloride (also known as Quaternium-15).

Embossing Process

The single ply samples were placed on a linerboard carrier sheet and fed through a lab 3 roll Beloit Wheeler Calender stack fitted with a magnesium embossing sleeve, with a diamond-like pattern (similar to the pattern in FIG. 10). The tissue sample side with the chemical application was positioned so that it was in contact with the embossing sleeve. The calendar was heated to ~80° C.

The following test was then performed on the embossed tissue web and compared to the tissue web prior to embossing:

Tensile Strength

The tensile test that was performed used tissue samples that were conditioned at 23° C.+/−1° C. and 50%+/−2% relative humidity for a minimum of 4 hours. The 2-ply samples were cut into 3 inch wide strips in the machine direction (MD) and cross-machine direction (CD) using a precision sample cutter model JDC 15M-10, available from Thwing-Albert Instruments, a business having offices located in Philadelphia, Pa., U.S.A.

The gauge length of the tensile frame was set to four inches. The tensile frame was an Alliance RT/1 frame run with TestWorks 4 software. The tensile frame and the software are available from MTS Systems Corporation, a business having offices located in Minneapolis, Minn., U.S.A.

A 3" strip was then placed in the jaws of the tensile frame and subjected to a strain of 10 inches per minute until the point of sample failure. The stress on the tissue strip is monitored as a function of the strain. The calculated outputs included the peak load (grams-force/3", measured in grams-force), the peak stretch (%, calculated by dividing the elongation of the sample by the original length of the sample and multiplying by 100%), the % stretch @ 500 grams-force, the tensile energy absorption (TEA) at break (grams-force*cm/cm$^2$, calculated by integrating or taking the area under the stress-strain curve up to 70% of sample failure), and the slope A (kilograms-force, measured as the slope of the stress-strain curve from 57-150 grams-force).

Each tissue code was tested in the machine direction (MD) and cross-machine direction (CD).

Figure 12:
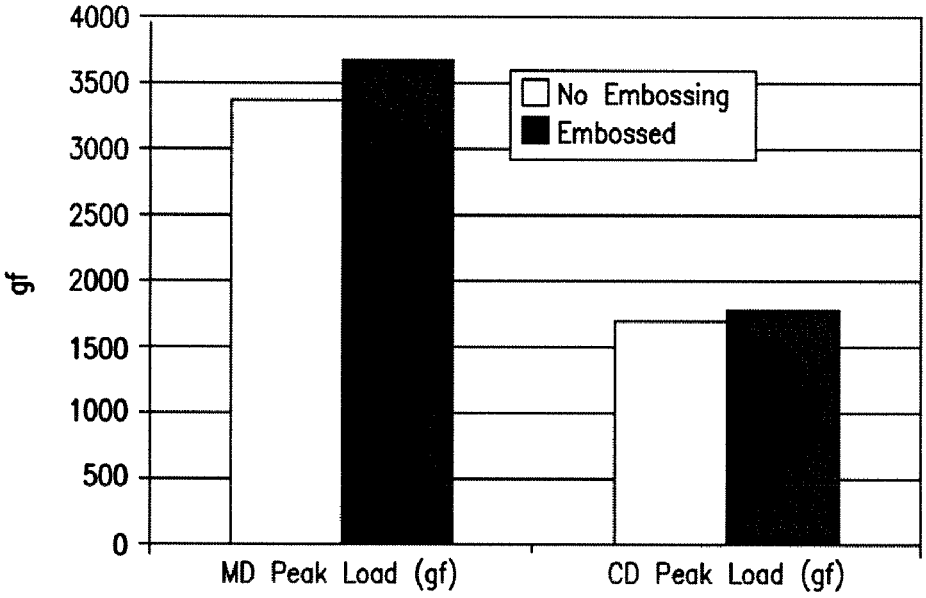
FIGS. 12 and 13 are the results obtained in the Example as described below.
Figure 13:
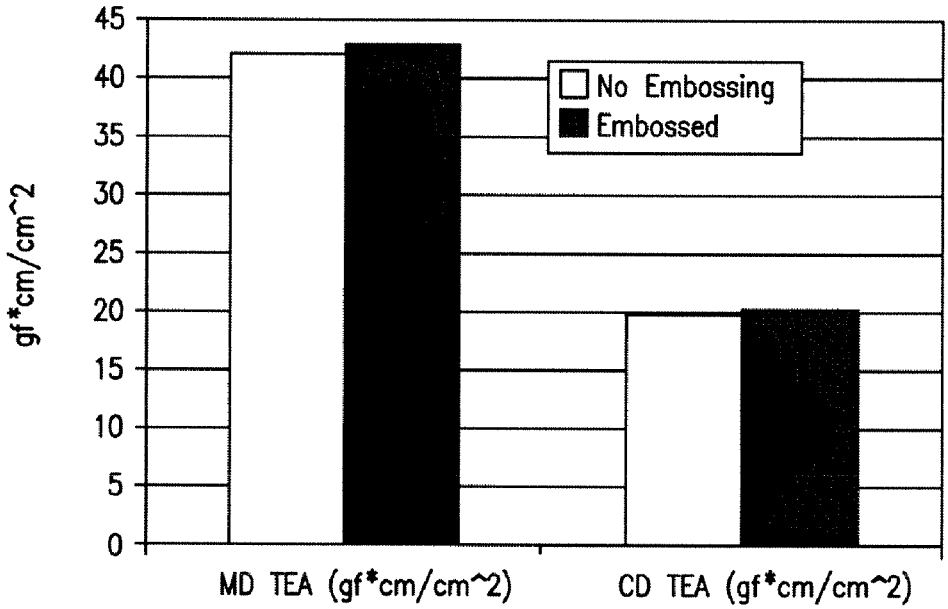

The results of the testing are graphically illustrated in FIGS. 12 and 13. As shown, even though embossing is known to deteriorate the strength of a tissue web, the strength of the web actually increased due to the presence of the additive composition.

Example No. 2

To illustrate the properties of products made in accordance with the present disclosure, various tissue webs were constructed and topically treated with an additive composition. The tissue webs were then plied together and subjected to an embossing process similar to the one illustrated in FIG. 9. During the embossing process, a pattern roll was heated to a temperature of approximately 80° C. The pressure and heat of the embossing process allowed the thermoplastic to flow between the plies creating a multi-ply laminate structure.

The properties of the embossed laminate structure were compared with the strength of the tissue webs prior to embossing. Additionally, an untreated tissue sample, and a tissue sample treated with an ethylene-vinyl acetate copolymer binder were also tested to show the benefits of incorporation of additive compositions made according to the present disclosure.

Tissue Basesheets

The following process was used to produce an uncreped through-air dried base web in a process similar to the process shown in FIG. 2. The basesheet had a basis weight of about 30 gsm.

Initially, 80 pounds of air-dried northern softwood kraft (NSWK) pulp from the Terrace Bay, ON, Canada mill of Neenah Paper Inc. was placed into a pulper and disintegrated for 15 minutes at 4% consistency at 120 degrees Fahrenheit. Then, the NSWK pulp was refined for 9 minutes, transferred to a dump chest and subsequently diluted to approximately 3% consistency. (Note: Refining fibrillates fibers to increase their bonding potential). Additionally, 80 pounds of air-dried southern softwood kraft (SSWK) pulp from the Mobile, Ala., USA mill of Alabama Pine Inc. was placed into a pulper and disintegrated for 15 minutes at 4% consistency at 120 degrees Fahrenheit. Then, the SSWK pulp was refined for 9 minutes, transferred to a dump chest and subsequently diluted to approximately 3% consistency. The SSWK and NSWK pulp were diluted to about 2% consistency and pumped to a machine chest, in a manner that the machine chest contained 20 air-dried pounds of a 1:1 ratio of SSWK to NSWK. The mixture was then diluted with fresh water to reduce the machine chest consistency to about 0.2-0.3%.

Eight kilograms KYMENE® 6500, available from Hercules, Incorporated, located in Wilmington, Del., U.S.A., per metric ton of wood fiber was added and allowed to mix with the pulp fibers for at least 10 minutes before pumping the pulp slurry through the headbox. The pulp fibers from all three machine chests were pumped to the headbox at a consistency of about 0.1%. The fibers were deposited on a forming fabric. Water was subsequently removed by vacuum.

The wet sheet, about 10-15% consistency, was transferred to a transfer fabric that was moving approximately 28% slower than the forming fabric. The basesheet was then where it was further dewatered, to about 15-25% consistency and transferred to an additional fabric. The sheet and fabric were dried utilizing hot air of approximately 400 degrees F. in a through dryer wound onto a 3" core into soft rolls for converting.

A second tissue basesheet was made utilizing the process shown in FIG. 3 to produce a creped base web. The basesheet had a basis weight of about 13.5 gsm. In this process the polyolefin composition was applied topical through spraying the additives onto the Yankee dryer prior to contacting the dryer with the tissue web. For purposes of comparison, samples were also produced using a standard PVOH/KYMENE crepe package.

Initially, 80 pounds of air-dried softwood kraft (NSWK) pulp was placed into a pulper and disintegrated for 15 minutes at 4% consistency at 120 degrees F. Then, the NSWK pulp was refined for 15 minutes, transferred to a dump chest and subsequently diluted to approximately 3% consistency. (Note: Refining fibrillates fibers to increase their bonding potential.) Then, the NSWK pulp was diluted to about 2% consistency and pumped to a machine chest, such that the machine chest contained 20 air-dried pounds of NSWK at about 0.2-0.3% consistency. The above softwood fibers were utilized as the inner strength layer in a 3-layer tissue structure.

Two kilograms KYMENE® 6500, available from Hercules, Incorporated, located in Wilmington, Del., U.S.A., per metric ton of wood fiber and two kilograms per metric ton of wood fiber PAREZ® 631 NC, available from LANXESS Corporation, located in Trenton, N.J., U.S.A., was added and allowed to mix with the pulp fibers for at least 10 minutes before pumping the pulp slurry through the headbox.

Forty pounds of air-dried Aracruz ECF, a eucalyptus hardwood Kraft (EHWK) pulp available from Aracruz, located in Rio de Janeiro, R J, Brazil, was placed into a pulper and disintegrated for 30 minutes at about 4% consistency at 120 degrees Fahrenheit. The EHWK pulp was then transferred to a dump chest and subsequently diluted to about 2% consistency.

Next, the EHWK pulp slurry was diluted, divided into two equal amounts, and pumped at about 1% consistency into two separate machine chests, such that each machine chest contained 20 pounds of air-dried EHWK. This pulp slurry was subsequently diluted to about 0.1% consistency. The two EHWK pulp fibers represent the two outer layers of the 3-layered tissue structure.

Two kilograms KYMENE® 6500 per metric ton of wood fiber was added and allowed to mix with the hardwood pulp fibers for at least 10 minutes before pumping the pulp slurry through the headbox.

The pulp fibers from all three machine chests were pumped to the headbox at a consistency of about 0.1%. Pulp fibers from each machine chest were sent through separate manifolds in the headbox to create a 3-layered tissue structure. The fibers were deposited and on a forming fabric. Water was subsequently removed by vacuum.

The wet sheet, about 10-20% consistency, was transferred to a press felt or press fabric where it was further dewatered. The sheet was then transferred to a Yankee dryer through a nip via a pressure roll. The consistency of the wet sheet after the pressure roll nip (post-pressure roll consistency or PPRC) was approximately 40%. The wet sheet adhered to the Yankee dryer due to an adhesive that is applied to the dryer surface. Spray booms situated underneath the Yankee dryer sprayed either an adhesive package, which is a mixture of polyvinyl alcohol/KYMENE®/Rezosol 2008M, or an additive composition according to the present disclosure onto the dryer surface. Rezosol 2008M is available from Hercules, Incorporated, located in Wilmington, Del., U.S.A.

One batch of the typical adhesive package on the continuous handsheet former (CHF) typically consisted of 25 gallons of water, 500 mL of a 6% solids polyvinyl alcohol solution, 75 mL of a 12.5% solids KYMENE® solution, and 20 mL of a 7.5% solids Rezosol 2008M solution. The additive compositions according to the present disclosure were applied at a solids content of approximately 5%.

The sheet was dried to about 95% consistency as it traveled on the Yankee dryer and to the creping blade. The creping blade subsequently scraped the tissue sheet and small amounts of dryer coating off the Yankee dryer. The creped tissue basesheet was then wound onto a 3" core into soft rolls for converting.

Chemical Application Process

The uncreped through air-dried tissue sheets were coated with several chemical compositions utilizing either a rotogravure printer in a typical printing process or by a rotogravure printer followed by a creping step in a process described as print creping.

During the printing process, the tissue web was fed into a gravure printing line where the additive composition was printed onto the surface of the sheet. One side of the sheet was printed using direct rotogravure printing. The sheet was printed with a 0.020 diameter "dot" pattern as shown in FIG. 5 wherein 28 dots per inch were printed on the sheet in both the machine and cross-machine directions. The resulting surface area coverage was approximately 25%. The solids of the solution being printed were controlled to approximately 30% to provide a 5% dry polymer add-on per dry tissue weight per printed side. The sheet traveled from the first print station to a second identical print station where the second side of the tissue was coated in a similar fashion. The sheet was then passed through a throughdryer that dried the printed web to approximately 95% solids utilizing an air temperature of approximately 120° C.

The print creping process is generally illustrated in FIG. 8. The sheet was fed to a gravure printing line where the additive composition was printed onto the surface of the sheet. One side of the sheet was printed using direct rotogravure printing. The sheet was printed with a 0.020 diameter "dot" pattern as shown in FIG. 5 wherein 28 dots per inch were printed on the sheet in both the machine and cross-machine directions. The resulting surface area coverage was approximately 25%. The sheet was then pressed against and doctored off a rotating drum, which had a surface temperature of 100° C. The solids of the solution being printed were controlled to approximately 30% to provide a 5% dry polymer add-on per dry tissue weight per printed side. The second side of the sheet was printed and creped in a similar method on the second side before the sheet was wound into a roll at an approximately 95% solids level.

Chemicals Applied

For samples treated with additive compositions made in accordance with the present disclosure, the following table provides the components of the additive composition for each sample. The olefin polymer dispersion used contained 60 wt % AFFINITY™ EG8200 plastomer and 40 wt % of PRIMACOR™ 5980i copolymer. The AFFINITY™ EG8200 is an alpha-olefin interpolymer comprising an ethylene and octene copolymer that was obtained from The Dow Chemical Company of Midland, Mich., U.S.A. It has a Melt Index of 5 g/10 min at 190C per 2.16 kg following ASTM D1238. The PRIMACOR™ 5980i copolymer is an ethylene-acrylic acid copolymer also obtained from The Dow Chemical Company and has a Melt Index of 13.75 g/10 min at 125C per 2.16 kg following ASTM D1238. The ethylene-acrylic acid copolymer can serve not only as a thermoplastic polymer but also as a dispersing agent. The dispersion also contained DOWICIL™ 200 antimicrobial obtained from The Dow Chemical Company, which is a preservative with the active composition of 96% cis 1-(3-chloroallyl)-3,5,7-triaza-1-azoniaadamantane chloride (also known as Quaternium-15). The olefin polymer dispersion had a solids content of 42%, an average volumetric particle size of 1.6, a poly dispersity of 2.2, and a pH of 11.

Additionally controls were made utilizing a formulation containing primarily of a commercially available ethylene-vinyl acetate copolymer emulsion obtained from Air Products, Inc. under the trade name AIRFLEX® 426. The AIRFLEX® 426 (63% solids) was mixed with KYMENE® 6500 (12.5% solids) available from Hercules, Incorporated, located in Wilmington, Del., U.S.A; HERCOBOND® 1366 (7.5% solids) available from Hercules, Incorporated, located in Wilmington, Del., U.S.A; PROTOCOL® Defoamer (100% solids) available from Hercules, Incorporated, located in Wilmington, Del., U.S.A; and NaOH (10% solids) to achieve a pH of approximately 7. The final formulation % dry weight consisted of 91% AIRFLEX® 426, 6% KYMENE® 6500, 2% HERCOBOND® 1366, and 1% PROTOCOL® Defoamer.

| Sample ID | Composition Applied to the Sample | Method of Addition | Approximate Composition add-on (%) |
|---|---|---|---|
| Control 1 | Untreated UCTAD | N/A | 2 |
| Control 2 | AIRFLEX ® 426 Binder | Printed | 2 |
| Control 3 | Control Creped tissue | N/A | 3 |
| Example 1 | AFFINITY ™ EG8200/ PRIMACOR ™ 5980i (60/40) | Printed | 2 |
| Example 2 | AFFINITY ™ EG8200/ PRIMACOR ™ 5980i (60/40) | Print-Creped | 2 |

-continued

| Sample ID | Composition Applied to the Sample | Method of Addition | Approximate Composition add-on (%) |
|---|---|---|---|
| Example 3 | AFFINITY ™ EG8200/ PRIMACOR ™ 5980i (60/40) | Crepe Package | 3 |
| Example 4 | AIRFLEX ® 426 Binder - exterior side AFFINITY ™ EG8200/ PRIMACOR ™ 5980i (60/40) - interior side | Printed | 2 |

Embossing Process

Before embossing and creating 2 ply samples, the tissue was positioned so that the printed or treated side was on the inside of the structures. For 3 ply structures the middle ply was not particularly positioned but the two outer plies were positioned so that the side was on the inside of the structures.

The samples were placed on a linerboard carrier sheet and fed through a lab 3 roll Beloit Wheeler Calender stack fitted with a magnesium embossing sleeve, with a criss-cross pattern. The samples were embossed at a pressure of 20 pli at 20 fpm at a temperature of 80° C.

Testing

The following tests were conducted on the samples:

Wet/Dry Tensile Test (% in the cross-machine direction), Geometric Mean Tensile Strength (GMT), and Geometric Mean Tensile Energy Absorbed (GMTEA):

The tensile tests that was performed used tissue samples that were conditioned at 23° C.+/−1° C. and 50%+/−2% relative humidity for a minimum of 4 hours. The 2-ply samples were cut into 3 inch wide strips in the machine direction (MD) and cross-machine direction (CD) using a precision sample cutter model JDC 15M-10, available from Thwing-Albert Instruments, a business having offices located in Philadelphia, Pa., U.S.A.

The gauge length of the tensile frame was set to four inches. The tensile frame was an Alliance RT/1 frame run with TestWorks 4 software. The tensile frame and the software are available from MTS Systems Corporation, a business having offices located in Minneapolis, Minn., U.S.A.

A 4" strip was then placed in the jaws of the tensile frame and subjected to a strain of 10 inches per minute until the point of sample failure. The stress on the tissue strip is monitored as a function of the strain. The calculated outputs included the peak load (grams-force/3", measured in grams-force), the peak stretch (%, calculated by dividing the elongation of the sample by the original length of the sample and multiplying by 100%), the % stretch @ 500 grams-force, the tensile energy absorption (TEA) at break (grams-force*cm/cm$^2$, calculated by integrating or taking the area under the stress-strain curve up to 70% of sample failure), and the slope A (kilograms-force, measured as the slope of the stress-strain curve from 57-150 grams-force).

Wet tensile strength was measured in the same manner as dry strength except that the samples were wetted prior to testing. Specifically, in order to wet the sample, a 3"×5" tray was filled with distilled or deionized water at a temperature of 23±2° C. The water is added to the tray to an approximate one cm depth.

A 3M "Scotch-Brite" general purpose scrubbing pad is then cut to dimensions of 2.5"×4". A piece of masking tape approximately 5" long is placed along one of the 4" edges of the pad. The masking tape is used to hold the scrubbing pad.

The scrubbing pad is then placed into the water with the taped end facing up. The pad remains in the water at all times until testing is completed. The sample to be tested is placed on blotter paper that conforms to TAPPI T205. The scrubbing pad is removed from the water bath and tapped lightly three times on a screen associated with the wetting pan. The scrubbing pad is then gently placed on the sample parallel to the width of the sample in the approximate center. The scrubbing pad is held in place for approximately one second. The sample is then immediately put into the tensile tester and tested. To calculate the wet/dry tensile strength ratio, the wet tensile strength value was divided by the dry tensile strength value.

Each tissue code (minimum of five replicates) was tested in the machine direction (MD) and cross-machine direction (CD). Geometric means of the tensile strength and tensile energy absorption (TEA) were calculated on the dry tissue tests as the square root of the product of the machine direction (MD) and the cross-machine direction (CD). This yielded an average value that is independent of testing direction. The samples that were used are shown below.

The results of the testing are shown in the following tables. As shown, even though embossing is known to deteriorate the strength of a tissue web, the strength of the web actually increased due to the presence of the additive composition.

| Sample ID | Basis Wt (gsm) | Number of Plies | Plies Laminated |
|---|---|---|---|
| Control 1 | 60 | 2 | No |
| Control 2 | 66 | 2 | No |
| Control 3 | 41 | 3 | No |
| Example 1 | 66 | 2 | Yes |
| Example 2 | 66 | 2 | Yes |
| Example 3 | 41 | 3 | Yes |
| Example 4 | 66 | 2 | Yes |

This above table indicates the presence of the olefin polymer dispersion was necessary to laminate the plies.

| Sample ID | Basesheet GMT (g/3") | Post-embossing GMT (g/3") | Basesheet GMTEA (gram-cm/cm2) | Post-embossing GMTEA (gram-cm/cm2) |
|---|---|---|---|---|
| Control 1 | 3960 | 3280 | 58 | 44 |
| Control 2 | 7880 | 6460 | 98 | 92 |
| Control 3 | 810 | 540 | 23 | 14 |
| Example 1 | 5290 | 6080 | 69 | 88 |
| Example 2 | 4230 | 4840 | 92 | 95 |
| Example 3 | 2420 | 2900 | 37 | 31 |
| Example 4 | 6870 | 6650 | 99 | 97 |

The above table indicates how the olefin dispersion increased the GMT and GMTEA during thermal embossing.

| Sample ID | Pre-embossing Wet/Dry Avg. (Std Dev) (%) | Post-embossing Wet/Dry Avg. (Std Dev) (%) |
|---|---|---|
| Control 1 | 31 | 31 |
| Control 2 | 41 | 43 |
| Control 3 | 24 | 25 |
| Example 1 | 38 | 55 |

-continued

| Sample ID | Pre-embossing Wet/Dry Avg. (Std Dev) (%) | Post-embossing Wet/Dry Avg. (Std Dev) (%) |
|---|---|---|
| Example 2 | 43 | 51 |
| Example 3 | 39 | 58 |
| Example 4 | 40 | 52 |

The above table indicates how the olefin dispersion increased the wet/dry during thermal embossing.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A tissue product comprising:

a tissue web comprising pulp fibers contained in the web in an amount of at least 50% by weight, the tissue web having a dry bulk of at least 3 cc/g;

an additive composition present on or in the tissue web, the additive composition comprising a non-fibrous olefin polymer and a dispersing agent, the olefin polymer comprising an alpha olefin interpolymer of ethylene or propylene and at least one comonomer, each comonomer being selected from the group consisting of octene, heptene, hexene, decene, and dodecene; and wherein the tissue web includes densified areas that have a defined structure in the tissue web and are formed where the additive composition resides, and wherein the densified areas are formed by embossing the tissue web.

2. A tissue product as defined in claim 1, wherein the tissue product is a single ply tissue product.

3. A tissue product as defined in claim 1, wherein the densified areas comprise embossments that are visible from at least one side of the tissue web.

4. A tissue product as defined in claim 3, wherein the embossments define a pattern, the pattern comprising a reticulated pattern.

5. A tissue product as defined in claim 3, wherein the embossments define a pattern, the pattern comprising a pattern of discrete shapes.

6. A tissue product as defined in claim 1, wherein the densified areas are formed by embossing the tissue web, and wherein the machine direction tensile strength of the tissue web and the cross machine direction tensile strength of the web decrease by no more than about 5% after being embossed.

7. A tissue product as defined in claim 1, wherein the tissue web has been formed according to a wetlaid process.

8. A tissue product as defined in claim 1, wherein the dispersing agent comprises a carboxylic acid, a salt of a carboxylic acid, a carboxylic acid ester, or a salt of a carboxylic acid ester.

9. A tissue product as defined in claim 1, wherein the dispersing agent comprises an ethylene-carboxylic acid copolymer.

10. A tissue product as defined in claim 1, wherein the additive composition comprises a mixture of the olefin polymer and an ethylene-carboxylic acid copolymer, the ethylene-carboxylic acid copolymer comprising an ethylene-acrylic acid copolymer.

11. A tissue product as defined in claim 1, wherein the additive composition is present on or in the tissue web in an amount from about 0.1% to about 20% by weight of the web.

12. A tissue product as defined in claim 1, wherein the tissue web has a basis weight of from about 6 gsm to about 40 gsm.

13. A tissue product as defined in claim 1, wherein the tissue web has a basis weight of from about 15 gsm to about 90 gsm.

14. A tissue product as defined in claim 1, wherein the olefin polymer comprises the alpha-olefin interpolymer of ethylene and the comonomer comprises 1-heptene, 1-hexene, 1-octene, 1-decene, or 1-dodecene.

15. A tissue product as defined in claim 1, wherein the olefin polymer comprises the alpha-olefin interpolymer of ethylene and the comonomer comprises octene.

16. A multiple ply tissue product comprising:

a first tissue web comprising pulp fibers, the first tissue web having a dry bulk of at least 3 cc/g;

a second tissue web comprising pulp fibers contained in the web in an amount of at least 50% by weight, the second tissue web having a dry bulk of at least 3 cc/g; and an additive composition present on or in at least one of the tissue webs, the additive composition comprising a non-fibrous olefin polymer, and a dispersing agent, and wherein the olefin polymer comprises an alpha olefin interpolymer of ethylene or propylene and at least one comonomer, each comonomer being selected from the group consisting of octene, heptene, hexene, decene, and dodecene, wherein the additive composition forms bond areas between the first tissue web and the second tissue web.

17. A multi-ply tissue product as defined in claim 16, wherein the multi-ply tissue product has been embossed to form the bond areas.

18. A multi-ply tissue product as defined in claim 17, wherein the bond areas comprise defined embossments in the tissue product, the embossments being visible from at least one side of the tissue product.

19. A multi-ply tissue product as defined in claim 18, wherein the tissue product has been embossed according to a pattern, the pattern being visible from at least one side of the tissue web.

20. A multi-ply tissue product as defined in claim 16, wherein the first tissue web and the second tissue web have been formed according to a wetlaid process.

21. A multi-ply tissue product as defined in claim 16, wherein the dispersing agent comprises a carboxylic acid, a salt of a carboxylic acid, a carboxylic acid ester, or a salt of a carboxylic acid ester.

22. A multi-ply tissue product as defined in claim 16, wherein the dispersing agent comprises an ethylene-carboxylic acid copolymer.

23. A multi-ply tissue product as defined in claim 16, wherein the additive composition comprises a mixture of the olefin polymer and an ethylene-carboxylic acid copolymer, the ethylene-carboxylic acid copolymer comprising an ethylene-acrylic acid copolymer.

24. A multi-ply tissue product as defined in claim 16, wherein the additive composition is present on or in at least one of the tissue webs in an amount from about 0.1% to about 20% by weight.

25. A multi-ply tissue product as defined in claim 16, wherein the additive composition was topically applied to at least one of the tissue webs.

26. A multi-ply tissue product as defined in claim 16, the olefin polymer having a particle size of from about 0.1 micron to about 5 microns prior to being incorporated into at least one of the tissue webs.

27. A multi-ply tissue product as defined in claim 16, wherein the olefin polymer comprises the alpha-olefin interpolymer of ethylene and the comonomer comprises 1-heptene, 1-hexene, 1-octene, 1-decene, or 1-dodecene.

28. A multi-ply tissue product as defined in claim 16, wherein the olefin polymer comprises the alpha-olefin interpolymer of ethylene and the comonomer comprises octene.

29. A process for producing a tissue product as defined in claim 1 comprising:

incorporating an additive composition into a tissue web, the tissue web comprising pulp fibers, the additive composition comprising a non-fibrous olefin polymer and a dispersing agent, and wherein the olefin polymer comprises an alpha olefin interpolymer of ethylene or propylene and at least one comonomer, each comonomer being selected from the group consisting of octene, heptene, hexene, decene, and dodecene; and embossing the tissue web to form densified fiber areas that have a defined structure in the tissue web, the defined structure being supported by the additive composition.

30. A process as defined in claim 29, wherein the densified areas comprise embossments that are visible from at least one side of the tissue web.

31. A process as defined in claim 30, wherein the embossments define a pattern, the pattern comprising a reticulated pattern.

32. A process as defined in claim 30, wherein the embossments define a pattern, the pattern comprising a pattern of discrete shapes.

33. A process as defined in claim 29, wherein the dispersing agent comprises a carboxylic acid, a salt of a carboxylic acid, a carboxylic acid ester, or a salt of a carboxylic acid ester.

34. A process as defined in claim 29, wherein the dispersing agent comprises an ethylene-carboxylic acid copolymer.

35. A process as defined in claim 29, wherein the additive composition comprises a mixture of the olefin polymer and an ethylene-carboxylic acid copolymer, the ethylene-carboxylic acid copolymer comprising an ethylene-acrylic acid copolymer.

36. A process as defined in claim 29, wherein the additive composition is present on or in the tissue web in an amount from about 0.1% to about 20% by weight of the web.

37. A process as defined in claim 29, wherein the additive composition is topically applied to the tissue web.

38. A process as defined in claim 29, wherein the tissue web during the embossing step is fed into a nip formed between a heated embossing roll and a backing roll.

39. A process as defined in claim 29, wherein the tissue web is embossed together with a second tissue web, the densified areas forming bond areas between the adjacent webs.

40. A process as defined in claim 29, wherein the tissue web is formed from an aqueous suspension of pulp fibers.

41. A process as defined in claim 29, wherein the olefin polymer comprises the alpha-olefin interpolymer of ethylene and the comonomer comprises 1 heptene, 1-hexene, 1-octene, 1-decene, or 1-dodecene.

42. A process as defined in claim 29, wherein the olefin polymer comprises the alpha-olefin interpolymer of ethylene and the comonomer comprises octene.

* * * * *